US011571028B2

(12) United States Patent
Ichigaya et al.

(10) Patent No.: US 11,571,028 B2
(45) Date of Patent: Feb. 7, 2023

(54) ELECTRIC COMPONENT MOUNTING UNIT FOR AIR-CONDITIONED GARMENT, AND AIR-CONDITIONED GARMENT

(71) Applicant: SFT LABORATORY CO., LTD., Tokyo (JP)

(72) Inventors: Hiroshi Ichigaya, Tokyo (JP); Yohei Oki, Tokyo (JP); Chongshi Zhang, Tokyo (JP)

(73) Assignee: SFT LABORATORY CO., LTD., Tokyo (JP)

( * ) Notice: Subject to any disclaimer, the term of this patent is extended or adjusted under 35 U.S.C. 154(b) by 0 days.

(21) Appl. No.: 16/083,423

(22) PCT Filed: Mar. 8, 2017

(86) PCT No.: PCT/JP2017/009179
§ 371 (c)(1),
(2) Date: Sep. 7, 2018

(87) PCT Pub. No.: WO2017/154961
PCT Pub. Date: Sep. 14, 2017

(65) Prior Publication Data

US 2019/0239578 A1 Aug. 8, 2019

(30) Foreign Application Priority Data

Mar. 9, 2016 (JP) ..... JP2016-045100
May 18, 2016 (JP) ..... JP2016-099407
Jan. 19, 2017 (JP) ..... JP2017-007146

(51) Int. Cl.
*A41D 13/005* (2006.01)
*A41D 13/002* (2006.01)

(52) U.S. Cl.
CPC ..... *A41D 13/005* (2013.01); *A41D 13/002* (2013.01); *A41D 13/0025* (2013.01); *F25D 2400/26* (2013.01)

(58) Field of Classification Search
CPC ..... A41D 3/002–0025; A41D 3/0053; F25D 2400/26
(Continued)

(56) References Cited

U.S. PATENT DOCUMENTS 7,731,575 B2 * 6/2010 Ozil ..... A62B 7/10 454/283
9,936,787 B1 * 4/2018 Jones ..... A45D 20/12
(Continued)

FOREIGN PATENT DOCUMENTS

JP 6430308 U 2/1989
JP 2005029914 A 2/2005
(Continued)

OTHER PUBLICATIONS

English translation of WO 2006/009108 Ichigaya 2006.*
(Continued)

*Primary Examiner* — Joel M Attey
(74) *Attorney, Agent, or Firm* — Holtz, Holtz & Volek PC

(57) ABSTRACT

An electric component mounting unit for an air-conditioned garment, which is used in combination with a garment body having a fan opening and which is mounted on a body, includes a fan which takes air from outside into the garment body, a mounter which mounts the fan on the body, and a fan attacher which attaches the fan to the mounter. The fan includes a fan-side linker which links the fan with the fan opening.

10 Claims, 22 Drawing Sheets

(58) Field of Classification Search
USPC ..... 62/259.3
See application file for complete search history.

(56) References Cited

U.S. PATENT DOCUMENTS

| | | | | |
|---|---|---|---|---|
| 2006/0140758 | A1* | 6/2006 | Ochiai | F04D 29/282 415/206 |
| 2007/0050878 | A1* | 3/2007 | Ichigaya | A41D 13/0025 2/69 |
| 2007/0271939 | A1 | 11/2007 | Ichigaya | |
| 2009/0208693 | A1 | 8/2009 | Ichigaya | |
| 2011/0048048 | A1* | 3/2011 | Gielda | F25B 1/06 62/259.3 |
| 2014/0090410 | A1* | 4/2014 | Decker | F04D 25/0673 62/259.3 |
| 2017/0067484 | A1 | 3/2017 | Ichigaya | |

FOREIGN PATENT DOCUMENTS

| | | | |
|---|---|---|---|
| JP | 2005054299 | A | 3/2005 |
| JP | 2006132040 | A | 5/2006 |
| JP | 4067034 | B2 | 3/2008 |
| JP | 2015065998 | A | 4/2015 |
| WO | 2005063065 | A1 | 7/2005 |
| WO | 2006-009108 | * | 1/2006 |
| WO | 2006009108 | A1 | 1/2006 |
| WO | 2006077876 | A1 | 7/2006 |
| WO | 2007061088 | A1 | 5/2007 |
| WO | 2015140926 | A1 | 9/2015 |
| WO | 2016021528 | A1 | 2/2016 |

OTHER PUBLICATIONS

International Search Report (ISR) dated May 30, 2017 issued in International Application No. PCT/JP2017/009179.
Written Opinion dated May 30, 2017 issued in International Application No. PCT/JP2017/009179.
International Preliminary Report on Patentability (IPRP) (and English translation thereof) dated May 1, 2018 issued in International Patent Application No. PCT/JP2017/009179.

* cited by examiner

ELECTRIC COMPONENT MOUNTING UNIT FOR AIR-CONDITIONED GARMENT, AND AIR-CONDITIONED GARMENT

TECHNICAL FIELD

The present invention relates to an electric component mounting unit for air-conditioned garment that is used with air-conditioned garment for cooling the body and to air-conditioned garment.

BACKGROUND ART

In recent years, air-conditioned garment for cooling the body has been put into practice and has been rapidly becoming common. As illustrated in FIG. 35A and FIG. 35B, a conventional air-conditioned garment 101 includes a garment body 110 sewn with a material that does not breathe well, two fans 140, 140 attached at a lower back part of the garment body 110, a power supply (not shown) for supplying electric power to the two fans 140, 140 and power cables (not shown) for electrically connecting the power supply with the two fans 140, 140.

When the fans 140 are turned on, a large amount of air is taken into the garment body 110 through the fans 140. The pressure of the taken air automatically forms an air pathway between the garment body 110 and the body or an underwear, and the taken air flows upward in the formed air pathway along the surface of the body or underwear and is discharged to the outside, for example, through a neck opening or sleeve openings. The neck opening and sleeve openings serve as air discharging portions 130.

The air evaporates sweat from the body while flowing in the air pathway between the garment body 110 and the body or underwear, and the body is cooled by the heat of vaporization (e.g. see Patent Document 1).

Such conventional air-conditioned garment 101 is designed in various ways so that it can bear the weight of the fans 140 and that the fans 140 do not come off from the garment body 110 even when the fans 140 are subjected to a pressure in different directions.

For example, a garment body 110 of typical air-conditioned garment 101 is made of a fabric material. The fans 140 easily come off by a small force since such fabric is stretchable. To avoid this, attaching holes for the fans 140 are specially processed. For example, a plastic reinforcing plate is sewn on the fabric so that the fabric is not teared by the weight of the fans 140 and can securely fix the fans 140.

PRIOR ART DOCUMENT

Patent Document

Patent Document 1: WO 2005/063065A

SUMMARY OF INVENTION

Problem to be Solved by Invention

However, a problem with the conventional air-conditioned garment 101 is that some additional labor is required in the production thereof since the special attaching holes for attaching the fans 140 have to be formed in the garment body 110 of the air-conditioned garment. Another problem is that it is impossible to completely prevent the electric components from coming off since the fans 140 and a power supply are attached to the garment.

Yet another problem is that the air-conditioned garment 101 is heavy in total since the fans 140 are attached to the garment body 110. Further, the vicinity of the attaching holes for the fans 140 billows due to positive pressure that is generated by taking in the outside air, which may sometimes disturb a work.

Furthermore, there are following various problems since the fans 140 are attached to the garment body 110, i.e. the fans 140 are suspended by the garment body 110.

1. When the body turns, the fans 140 further get away from the body due to a centrifugal force, which increases the probability of collision with the surroundings.

2. When the fans 140 are subjected to an external force in different directions (e.g. when the fans 140 collide with an object or the user jumps), the fans 140 and the internal components thereof are subjected to an impact. The fans 140 have to have a robust structure that can withstand such impact. In particular, when fitting of a fan blade (propeller) on a motor shaft is tightened so that the fan blade does not come off by an impact, a motor bearing is deformed in the process of press-fitting the motor shaft into the fan blade, which becomes a cause of noise.

3. When the fan blade is rotated, the unbalance or the like of the fan blade causes vibration. While the vibration has a negative influence on the lifetime of the motor and generates noise, it is not easy to take a measure such as absorbing the noise since the fans are suspended.

It is an object of the present invention to provide an electric component mounting unit for air-conditioned garment and air-conditioned garment in which an electric component is prevented from coming off and which enables readily attaching a fan without making a special attaching hole in a garment body of air-conditioned garment.

Means for Solving Problem

In order to accomplish the object, the invention according to claim 1 is an electric component mounting unit for air-conditioned garment which is used in combination with a garment body having a fan opening and which is mounted on a body, including:

a fan which takes air from an outside into the garment body;

a mounter which mounts the fan on the body; and a fan attacher which attaches the fan to the mounter, wherein the fan comprises a fan-side linker which links the fan with the fan opening.

The invention according to claim 2 is the electric component mounting unit for air-conditioned garment according to claim 1, wherein the fan comprises a fan body and a cover which houses the fan body, and wherein the fan-side linker comprises a cylindrical linker formed at the cover.

The invention according to claim 3 is the electric component mounting unit for air-conditioned garment according to claim 2, further including:

an upper flange at an air inlet-side of the cylindrical linker; and a lower flange at an air outlet-side of the upper flange, wherein an opening edge of the garment body having the fan opening is to be fitted in a groove between the upper flange and the lower flange.

The invention according to claim 4 is the electric component mounting unit for air-conditioned garment according to any one of claims 1 to 3, wherein the mounter comprises a belt that is constituted by a cord, a band or a combination of a cord and a band.

The invention according to claim 5 is the electric component mounting unit for air-conditioned garment according to claim 4, wherein the mounter is partly or fully elastic or comprises a length adjuster.

The invention according to claim 6 is the electric component mounting unit for air-conditioned garment according to claim 4 or 5, wherein the garment body is constituted by a front-open garment which comprises a fastener for opening and closing right and left front parts, and wherein ends of the mounter are attached respectively to the right and left front parts, so that the garment body serves as a part of the mounter and that the fastener serves as a connector of the mounter.

The invention according to claim 7 is the electric component mounting unit for air-conditioned garment according to any one of claims 4 to 6, wherein the fan comprises two fans, and the two fans are connected by a power cable.

The invention according to claim 8 is the electric component mounting unit for air-conditioned garment according to any one of claims 4 to 7, wherein the fan attacher is detachably attached to the mounter.

The invention according to claim 9 is the electric component mounting unit for air-conditioned garment according to any one of claims 4 to 8, further including:

a movable means which makes the fan movable in a longitudinal direction of the mounter when the fan is attached to the mounter.

The invention according to claim 10 is the electric component mounting unit for air-conditioned garment according to claim 3, further including:

a power supply which supplies electric power to the fan; and a power cable, wherein the fan, the power cable and the power supply are linked to each other to serve as a part of the mounter.

The invention according to claim 11 is the electric component mounting unit for air-conditioned garment according to any one of claims 1 to 10, further including:

a power supply which supplies electric power to the fan; and a power supply attacher which attaches the power supply to the mounter.

The invention according to claim 12 is the electric component mounting unit for air-conditioned garment according to any one of claims 1 to 3, further including:

a unit in which the fan and a power supply for supplying electric power to the fan are integrated.

The invention according to claim 13 is the electric component mounting unit for air-conditioned garment according to claim 12, wherein in the unit, a motor and a power supply is contained in a hermetic container.

The invention according to claim 14 is the electric component mounting unit for air-conditioned garment according to claim 12 or 13, wherein the unit comprises:

an electric component mounting plate to be mounted on a back or a chest; and a fan attacher which detachably fixes the fan on the electric component mounting plate.

The invention according to claim 15 is the electric component mounting unit for air-conditioned garment according to any one of claims 12 to 14, further including:

an air improver which is disposed around an air inlet of the fan and which removes a harmful substance to a human body from air that has been or is to be taken in from the outside, adds a useful substance to the human body to the air, or cools the air.

The invention according to claim 16 is the electric component mounting unit for air-conditioned garment according to any one of claims 1 to 15, further including:

a power supply which supplies electric power to the fan; and a solar panel, wherein the power supply comprises a power storage for storing or utilizing electricity generated by the solar panel.

The invention according to claim 17 is the electric component mounting unit for air-conditioned garment according to any one of claims 1 to 16, further including:

a power supply which supplies electric power to the fan;

a communicator which communicates with an external apparatus; and a controller which controls the communicator to control ON/OFF of the power supply and/or a rotation speed of the fan based on an instruction received from the external apparatus.

The invention according to claim 18 is the electric component mounting unit for air-conditioned garment according to any one of claims 1 to 17, further including:

a power supply which supplies electric power to the fan;

a measure which measures vital information; and a controller which controls ON/OFF of the power supply and/or a rotation speed of the fan based on a measurement result of the measure.

The invention according to claim 19 is the electric component mounting unit for air-conditioned garment according to claim 18, further including:

a communicator which communicates with an external apparatus, wherein the controller controls the communicator to send the measurement result of the measure to the external apparatus.

The invention according to claim 20 is an air-conditioned garment including:

an electric component mounting unit for air-conditioned garment according to any one of claims 1 to 19; and the garment body which is made of a sheet material having the fan opening and which is designed to cover at least a part of the body, wherein the cylindrical linker of the fan is fitted in the fan opening.

The invention according to claim 21 is the air-conditioned garment according to claim 20, wherein the garment body is stretchable around an opening edge of the fan opening.

The invention according to claim 22 is the air-conditioned garment according to claim 20 or 21, wherein the fan is disposed at a front part of the garment body, and a spacer is disposed between a back part of the garment body and the body.

The invention according to claim 23 is the air-conditioned garment, including:

an electric component mounting unit for air-conditioned garment according to any one of claims 4 to 10; and the garment body which is made of a sheet material having the fan opening and which is designed to cover at least a part of the body, wherein both ends of the mounter of the electric component mounting unit for air-conditioned garment are attached near a fastener of the garment body, and the electric component mounting unit for air-conditioned garment is mounted on the body by changing a state of the fastener from an opened state to a closed state.

The invention according to claim 24 is the air-conditioned garment according to any one of claims 20 to 23, wherein the garment body is made of a plastic film.

The invention according to claim 25 is the air-conditioned garment according to any one of claims 20 to 24, wherein the garment body comprises an air discharging portion, and wherein the air discharging portion comprises a discharge resistance adjuster which adjusts a discharge resistance of air to be discharged.

Advantageous Effects of Invention

With the present invention, it is possible to provide an electric component mounting unit for air-conditioned garment and air-conditioned garment in which an electric component is prevented from coming off and which enables readily attaching a fan without making a special attaching hole in a garment body of air-conditioned garment.

BRIEF DESCRIPTION OF DRAWINGS

FIG. 25B is a schematic side view of the unit to which a rain cover is attached, which allows taking the outside air from a lower side so that rain does not get in.

FIG. 298 is a schematic back view of the fan according to the fifth embodiment.

EMBODIMENTS FOR CARRYING OUT INVENTION

Embodiments

Figure 1:
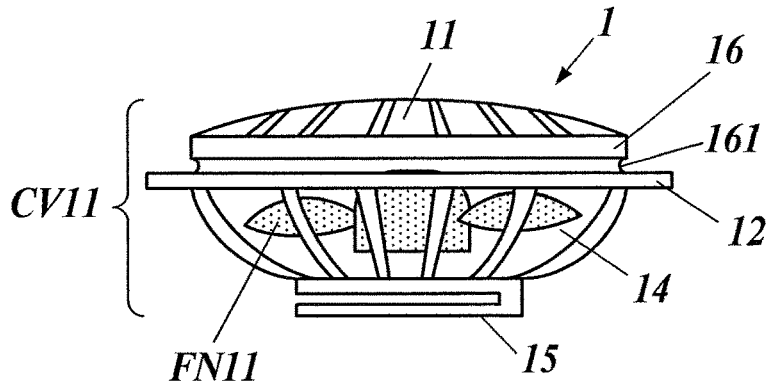
FIG. 1 is a schematic side view of an example of a fan of an electric component mounting unit for air-conditioned garment according to a first embodiment.

Hereinafter embodiments for carrying out the invention of the present application will be described referring to the drawings. However, the scope of the invention is not limited to the illustrated examples.

First Embodiment

The following is a case in which air-conditioned garment with an electric component mounting unit for air-conditioned garment of the present invention is rented for watching a game in an un-air-conditioned sport facility. Further, the air-conditioned garment is used as eco-friendly air-conditioned garment with a disposable garment body.

First, fans will be described.

FIG. 1 is a schematic side view of a fan 1. The fan 1 includes a fan body FN11 and a cover CV11 that houses the fan body FN11 (the cover CV11 including an air inlet 11, a cylindrical linker 16, which is a linker having a cylindrical shape, a flange 12 that protrudes outward from a middle part of the cylindrical linker 16, an air outlet 14 and a fan attacher 15). For example, the fan attacher 15 is constituted by a strong clip that is formed on a bottom of the fan and that firmly pinches a belt body (described later) so that an electric component is prevented from coming off even in a strenuous movement.

For example, the fan body FN11, which includes a fan blade (propeller fan) and a motor for rotating the fan blade, is housed in the cover CV11. In the cover CV11, the cylindrical linker 16 is formed between the air inlet 11 and the air outlet 14 that are opposed to each other, and the fan attacher 15 is provided at the air outlet 14.

The cylindrical linker 16 is fitted in a fan opening 53 of the garment body of the air-conditioned garment so as to serve as a fan-side linker for linking the fan 1 to the garment body.

The flange 12 is disposed between the cylindrical linker 16 and the air outlet 14. Further, a ring groove 161 is formed in the outer circumferential surface of the cylindrical linker 16 above the flange.

Next, the electric component attaching belt 2 as a mounter will be described.

Figure 2A:
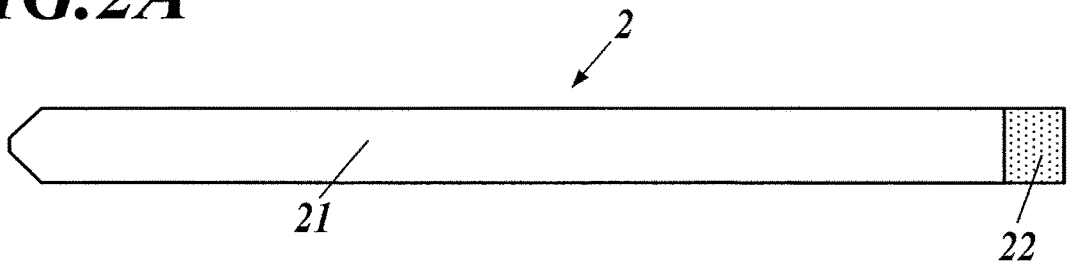
FIG. 2A is a schematic front view of an electric component attaching belt.

FIG. 2A is a schematic front view of the electric component attaching belt 2. A belt body (mounter) 21 has roughly the same structure as a belt for pants, and an attachment adjuster 23 is provided for attaching and adjusting the belt body at a side of the body. For example, the electric component attaching belt 2 is a belt having a width of approximately 6 cm, which includes a fixture (not shown) for power cables in a suitable position.

Figure 2B:
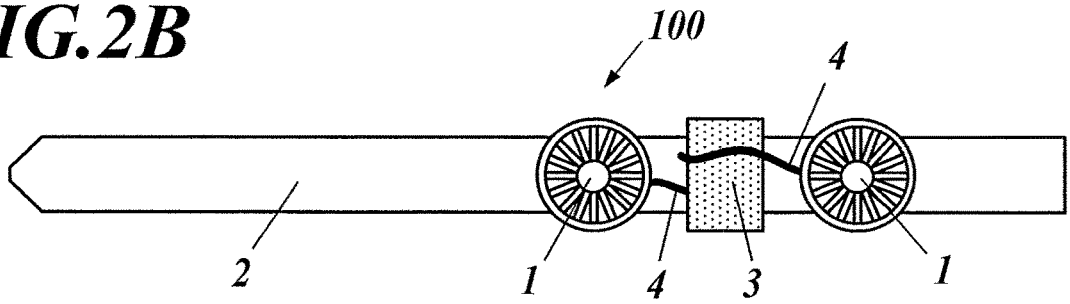
FIG. 2B is a schematic front view of the electric component attaching belt (electric component mounting unit for air-conditioned garment) to which fans and a power supply are attached.
Figure 2C:
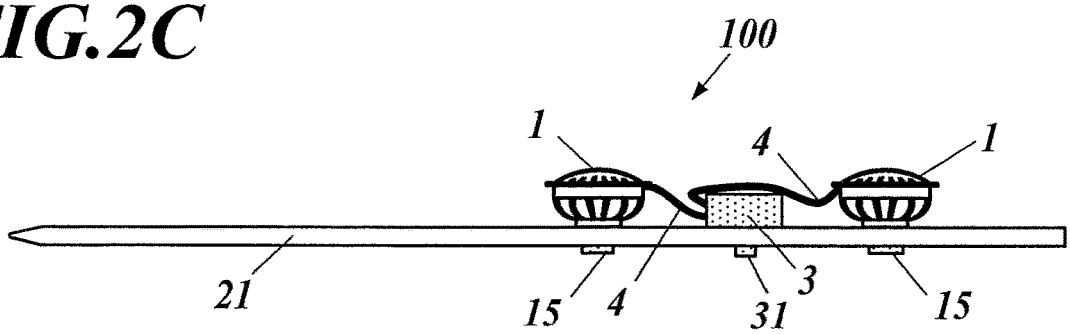
FIG. 2C is a schematic side view of the electric component attaching belt (electric component mounting unit for air-conditioned garment) to which fans and a power supply are attached.

FIG. 2B and FIG. 2C are a schematic front view and a schematic side view of the electric component attaching belt 2 with the fans 1 and the power supply 3 (electric component mounting unit 100 for air-conditioned garment). The power supply 3 is attached at the center by a clip as a power supply attacher 31, the power supply 3 is connected to the fans 1 by power cables 4, and the fans 1 are attached by clips as fan attacher 15. All electric components are collectively attached to the electric component attaching belt 2.

Next, the disposable garment body will be described.

In the embodiment, the garment body is made from an existing 45-L polyethylene bag (hereinafter referred to as a poly bag)

For example, a transparent 45-L poly bag with a size of 65 cm wide, 80 cm long and 0.02 mm thick is used.

Figure 3:
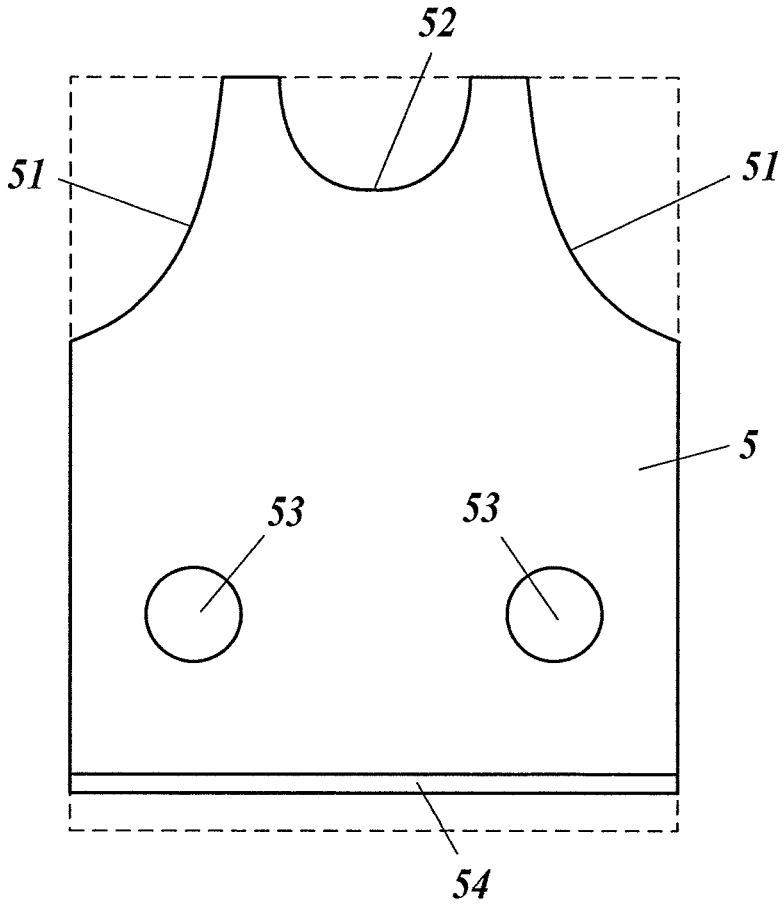
FIG. 3 is a schematic front view of an example of a garment body which is used with the electric component mounting unit for air-conditioned garment according to the first embodiment.

FIG. 3 is a schematic front view of the garment body 5 with a sealed side up, in which the dashed line represents the 45-L poly bag itself, and the solid line represents the garment body that is formed by the following steps 1 to 3 of cutting and opening.

1. Cut out cloths 51 and a neck 52 to form into the shape of a tank top.
2. Form fan openings 53 at both lower sides (15 cm apart from the center) of a belly part, which have a circular shape with a diameter that is slightly less than the diameter of the cylindrical linkers 16 of the fans 1.
3. Form a hem cord guide 54 at a hem.

The difference between fan attaching holes of conventional air-conditioned garment and the fan openings 53 of the embodiment will be described. In the conventional air-conditioned garment, the fans are attached to the garment body. Accordingly, it is necessary to sufficiently reinforce the attaching holes for the fans 1 as described above.

In contrast, in the present invention, the fans 1 are attached to the electric component attaching belt 2. Since no force acts between the fans 1 and the garment body 5, it is only necessary to simply form the openings in the embodiment. That is, it is possible to provide the electric component mounting unit 100 for air-conditioned garment that does not require special attaching holes for attaching the fans 1 to the garment body 5 and that can perfectly prevent the electric components from falling.

Next, a preparation for rent will be described.

The electric component attaching belt 2 (electric component mounting unit 100 for air-conditioned garment) with the two fans 1, the power supply 3 and the power cables 4 integrated thereon and the garment body 5 with a cord attached to the hem cord guide 54 are rented.

Next, a procedure for the use by a user will be described.

First, the electric component attaching belt 2 (electric component mounting unit 100 for air-conditioned garment) is worn around the body, and then the garment body 5 is put on.

Then, the fan openings 53 are fitted on the cylindrical linker 16 from the outer side of the fans 1, edges of the fan openings 53 are put into the grooves 161 above the flanges 12, and the edges of the fan openings 53 are linked to the cylindrical linkers 16 of the fans so that they are proximate to the upper faces of the flanges 12. Since polyethylene film is stretchable material, they are readily linked.

Figure 4:
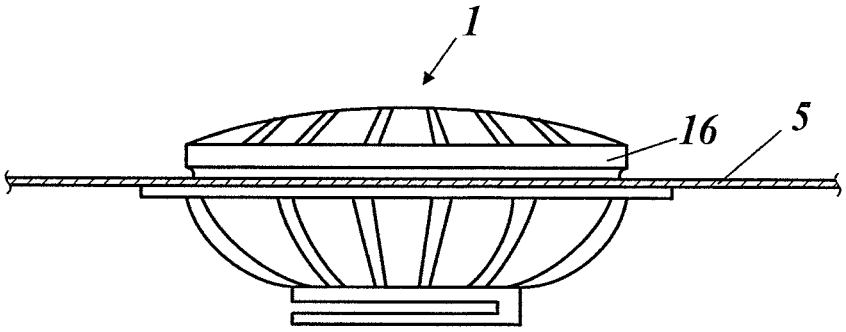
FIG. 4 is a schematic side view of a fan attached to the garment body.

FIG. 4 is an explanatory view illustrating the relationship between the fans 1 and the fan openings 53.

After the edges of the fan openings 53 of the garment body 5 are fitted on the cylindrical linkers 16, they are put into the small grooves 161 that are formed in the cylindrical linkers 16 and have a smaller diameter than the outer circumferential surface of the cylindrical linkers 16 as illustrated in FIG. 4. Accordingly, the edges are secured, and the garment body 5 and the fans 1 are thus linked to each other. In this case, the cylindrical linkers 16 of the fans 1 serve as fan-side linkers.

Finally, the cord in the hem cord guide 54 is tightened with a cord stopper (not shown), and the power supply 3 is operated to drive the fans 1.

Figure 5:
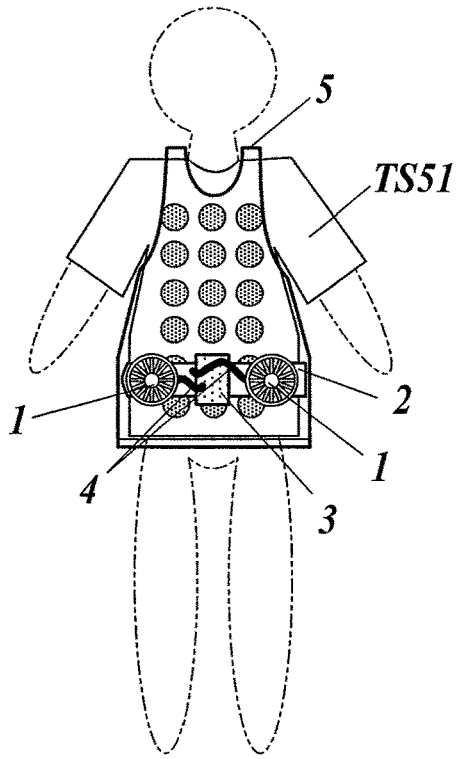
FIG. 5 is a schematic front view of the garment body worn on the body, to which the electric component mounting unit for air-conditioned garment according to the first embodiment is attached.

FIG. 5 is a schematic front view of the electric component attaching belt 2 (electric component mounting unit 100 for air-conditioned garment) and the garment body 5 in use, which are worn over a polka-dot T-shirt TS51.

When the cord in the hem cord guide 54 is tightened (air leakage preventing means), the air taken in by the fans 1 is blown into the garment body 5 without leakage through the hem so as to generate a positive pressure between the garment body 5 and the inner T-shirt TS51. An air pathway is thus automatically formed, and the air moves upward toward the neck and the arms (which serve as air discharging portions) and is discharged. That is, the air in the garment body 5 is ventilated.

The cooling effect by the air flow and evaporation of sweat by the air flow is the same as that of conventional air-conditioned garment.

Since the garment body 5 is made of polyethylene film, there is no air leakage through the garment body 5, which is inevitable in conventional air-conditioned garment. Further, since the garment body 5 is transparent, only the fans 1, the power supply 3 and the power cables 4 are visible. Since the polka-dot T-shirt TS51 is visible through the garment body 5 in the other part, a feeling of strangeness about the outer appearance is greatly reduced.

In the above-described production method, the garment body is made from an existing 45-L poly bag. However, it is, of course, more reasonable to produce the garment body 5 for the air-conditioned garment from scratch.

In the air-conditioned garment of the first embodiment, the electric component attaching belt 2 is used, and the fans 1 are fixed on the electric component attaching belt 2. Since the garment body 5 is not subjected to a load, not only the above-described "problems" are solved, but also the garment body itself has the following advantageous effects compared to the conventional air-conditioned garment.

1. Since the weight of the fans 1 is not applied to the fan openings 53 of the garment body 5 at all, it is not necessary to reinforce the fan openings 53.

2. Since it is not necessary to reinforce the fan openings 53, it is possible to employ plastic film with a thickness of 0.05 mm or less as the material of the garment body 5.

Variation

An electric component mounting unit 100*a* for air-conditioned garment that can be used with a variety of garment bodies will be described.

Figure 6:
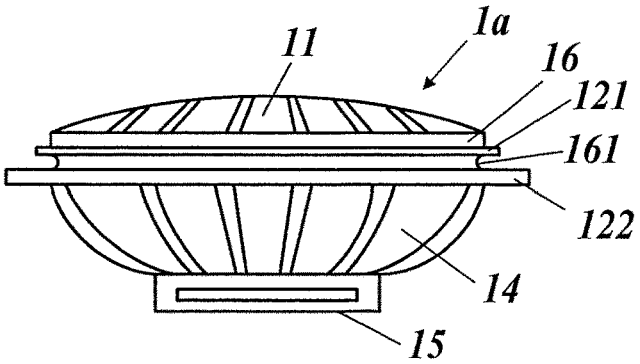
FIG. 6 is a schematic side view of another example of the fan.

FIG. 6 is a schematic side view of a fan 1*a* of the variation.

In the variation, at a cylindrical linker 16, as illustrated in FIG. 6, a fan body (not shown) is housed inside the cover. In the cover, a cylindrical linker 16 is formed between an air inlet 11 and an air outlet 14 that are opposed to each other, and a fan attacher 15 is provided at the air outlet 14. On the outer circumferential surface of the cylindrical linker 16, an upper flange 121 and a lower flange 122 are formed respectively in the upper and the lower parts thereof. Accordingly, a ring groove 161 is formed between the upper flange 121 and the lower flange 122. In the fans 1 of the first embodiment as illustrated in FIG. 1, the part above the groove 161 of the cylindrical linker 16 can be regarded as an upper flange 121.

The cylindrical linker 16 is inserted in a fan opening 53 of a garment body of air-conditioned garment to serve as a fan-side linker for linking the fan 1 to the garment body.

For example, a fan attacher 15 is constituted by a flat through hole (e.g. flat hole with a width of 26 mm) for receiving a belt body 2*a* as a movable means. In this case, the fan 1 is movable on the belt body 2*a*. However, the fan 1 does not come off even when it is moved on the belt body 2*a* during use. Accordingly, the fan 1 can be regarded to be substantially fixed on the belt body 2*a*.

Figure 7:
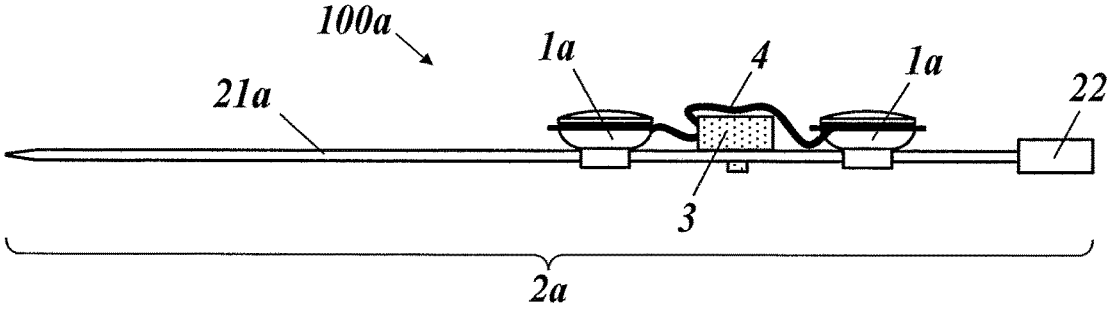
FIG. 7 is a schematic side view of the electric component mounting unit for air-conditioned garment in a different state.

FIG. 7 is a schematic side view of an assembled electric component attaching belt 2*a*. The electric component attaching belt 2*a* is approximately the same as the belt of the first embodiment. However, the width is less than the width of the electric component attaching belt 2, e.g. 25 mm.

Next, a method of assembling the electric component attaching belt 2*a* will be described.

FIG. 7 is a schematic side view of the assembled electric component attaching belt 2*a* (electric component mounting unit 100*a* of air-conditioned garment).

The end without an attachment adjuster 23 of the belt body 2*a* is inserted into the flat through holes, which serve as fan attacher 15 of the fans 1*a*, and the fans 1 are moved to the left or right (e.g. 15 cm to the left or right) from the part corresponding to the center of the abdomen.

Then, a power supply 3 is attached at the middle, and power cables 4 are connected to the fans 1*a* and the power supply 3. Since the assembled electric component attaching belt 2*a* (electric component mounting unit 100*a* for air-conditioned garment) has the above-described configuration, the fans 1*a* can be moved to the right or left. That is, the electric component attaching belt 2*a* can be used with a variety of garment bodies 5 that have different distances between fan openings 53 of the garment bodies 5.

Next, the following is a case of using the electric component attaching belt 2*a* of the variation and the garment body 5*a* that is a jacket made of thin polyvinyl chloride. With regard to the shape, the garment body 5*a* has a similar structure to a conventional jacket garment body 110, but only the fan openings 53 are different as follows.

1. The fan openings 53 are open to the front side.

2. Instead of reinforcement as in conventional attaching holes, elastic rings, specifically rubber bands (elastic rings 6*a*), are provided at the inner edges of the fan openings 53.

Figure 8:
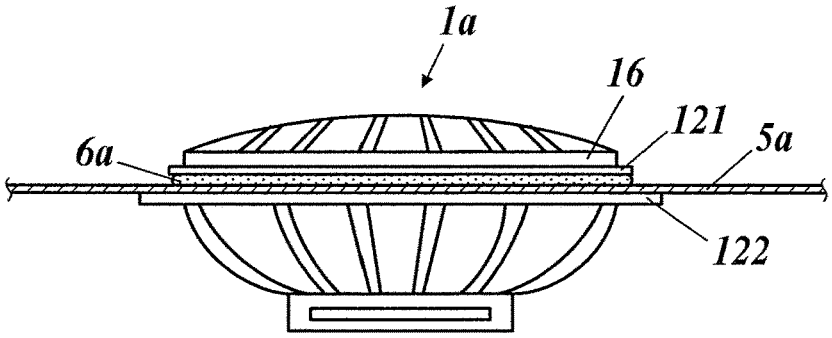
FIG. 8 is a schematic side view of the fan attached to the garment body in a different state.

FIG. 8 is an explanatory view illustrating the relationship between the cylindrical linkers 16 of the fans 1*a* and the edges of the fan openings 53.

After the edges of the fan openings 53 of the garment body 5*a* are fitted on the cylindrical linkers 16, they are put into the grooves 161, a part of the cylindrical linkers 16, through the upper flanges 121 as illustrated in FIG. 8. Accordingly, the edges are secured, the garment body 5 and the fans 1 are thus linked to each other. In this case, the cylindrical linkers 16 of the fans 1 serve as fan-side linkers.

The lower flanges 122 that are formed below the grooves 161 can prevent the edges of the fan openings 53 from moving further downward.

The electric component attaching belt 2*a* and the garment body 5*a* are produced as described above. Accordingly, after the electric component attaching belt 2*a* is worn around the body and the garment body 5*a* is put on, the lateral position of the fans 1*a* is roughly adjusted before a front zipper is closed.

Then, the fan openings 53 are fitted onto the cylindrical linkers of the fans 1*a* beyond the upper flanges 121 so that the edges with the elastic rings 6*a* of the fan openings 53 are put into the ring grooves. Thereafter, the zipper is closed, and the lateral position of the fans 1*a* is finely adjusted if necessary.

The technique that allows the edges of the fan openings 53 to be put into the ring grooves beyond the upper flanges 121 is not limited to providing the elastic rings at the inner edges of the fan openings 53. However, the fan openings 53 have to be stretchable or the like. Another technique of imparting stretchability is to use a stretchable sheet material for the sheet around the fan openings 53.

Second Embodiment

In the electric component mounting unit 100, 100*a* for air-conditioned garment of the first embodiment and the variation thereof, the fans, the power cables and the power supply are attached on the belt body. In the second embodiment, electric components themselves serve a s a part of belt bodies 21, 21*a*. In the following description of this embodiment and the variation thereof, an electric component mounting unit for air-conditioned garment is also referred to simply as an air-conditioning unit.

Figure 9:
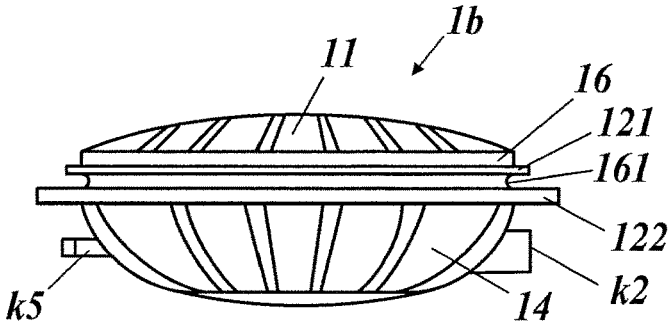
FIG. 9 is a schematic side view of a fan according to a second embodiment.
Figure 10:
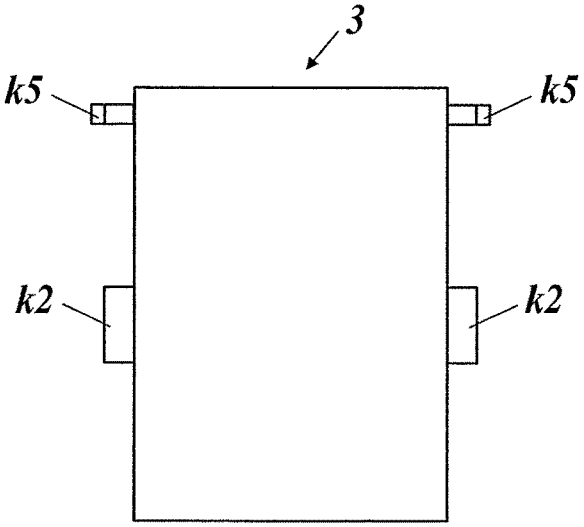
FIG. 10 is a schematic front view of a power supply according to the second embodiment.
Figure 11A:
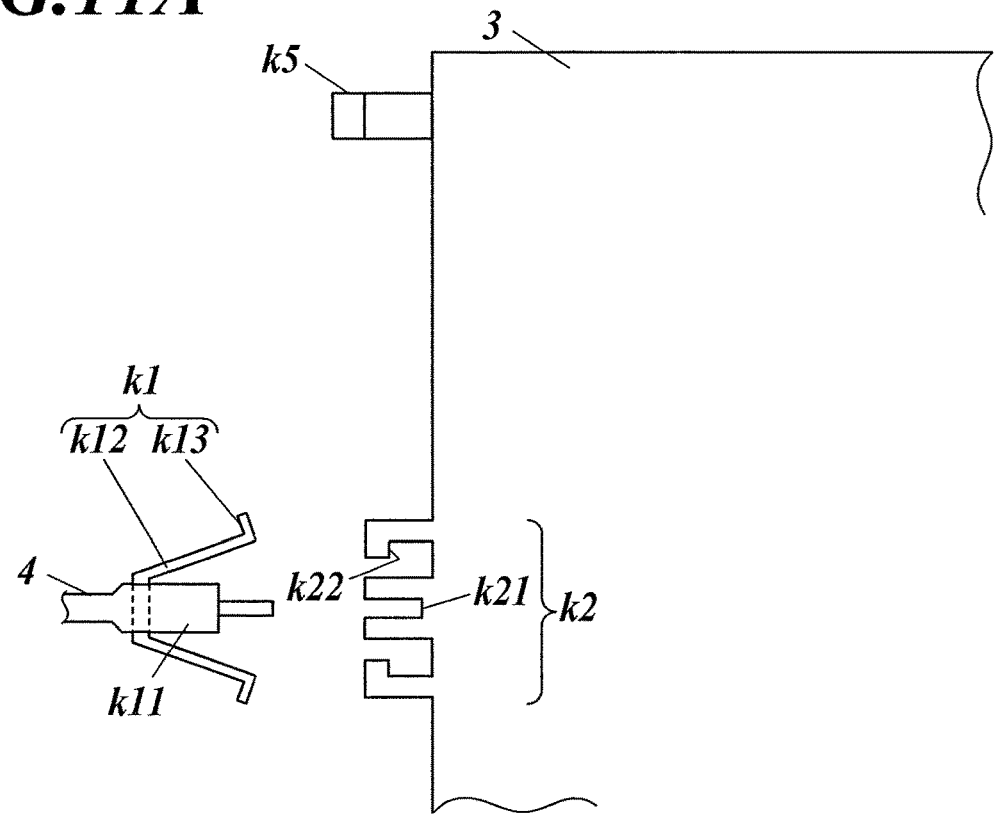
FIG. 11A is a schematic view of a terminal of a power cable and a terminal of the power supply that are not connected to each other.
Figure 11B:
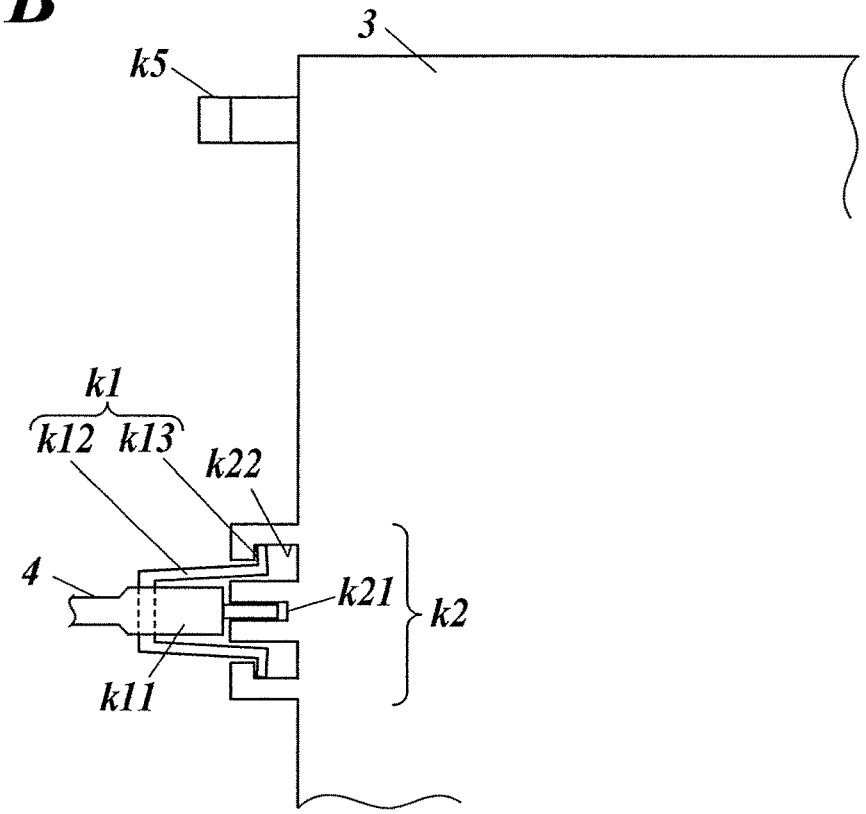
FIG. 11B is a schematic view of the terminal of the power cable and the terminal of the power supply that are connected to each other.

FIG. 9 is a schematic side view of a fan, FIG. 10 is a schematic front view of a power supply, FIG. 11A is a schematic view of a terminal of a power cable and a terminal of the power supply that are not connected to each other, FIG. 11B is a schematic view of the terminal of the power cable and the terminal of the power supply that are connected to each other.

As illustrated in FIG. 11A, the terminal (plug) k11 of the power cable 4 includes two fitting springs k12 with fitting walls k13 respectively at the upper and the lower parts, which serve as a male fitting (connector) k1 for mechanical fitting with the power supply 3. The terminal (jack) k21 of the power supply 3 includes fitting walls k22 respectively at the upper and lower parts for fitting with the fitting walls k13, which serve as a female fitting (connector) k2. With this configuration, once a user pinches the fitting springs k12 with the thumb and the index finger to reduce the gap between two fitting walls k13, inserts the plug k11 into the jack k21 and then releases the fingers, the fitting walls k13 fit with the fitting walls k22 as illustrated in FIG. 11B, and the power cable 4 becomes undetachable from the power supply 3 even when a force of separating the power cable 4 from the power supply 3 is applied. Terminals for connecting the fans 1*b* with the power cables have the same configuration. Specifically, the same female fittings k2 as those of the power supply 3 are formed at lower right parts of the fans 1*b* as illustrated in FIG. 9. Further, hooks k5 for connection with a waist belt k3 (described below) are formed at lower left parts of the fans 1*b*. The technique of firmly connecting the power supply and the fans with the power cable is not limited to the above-described technique, and various general techniques may be used.

Figure 12:
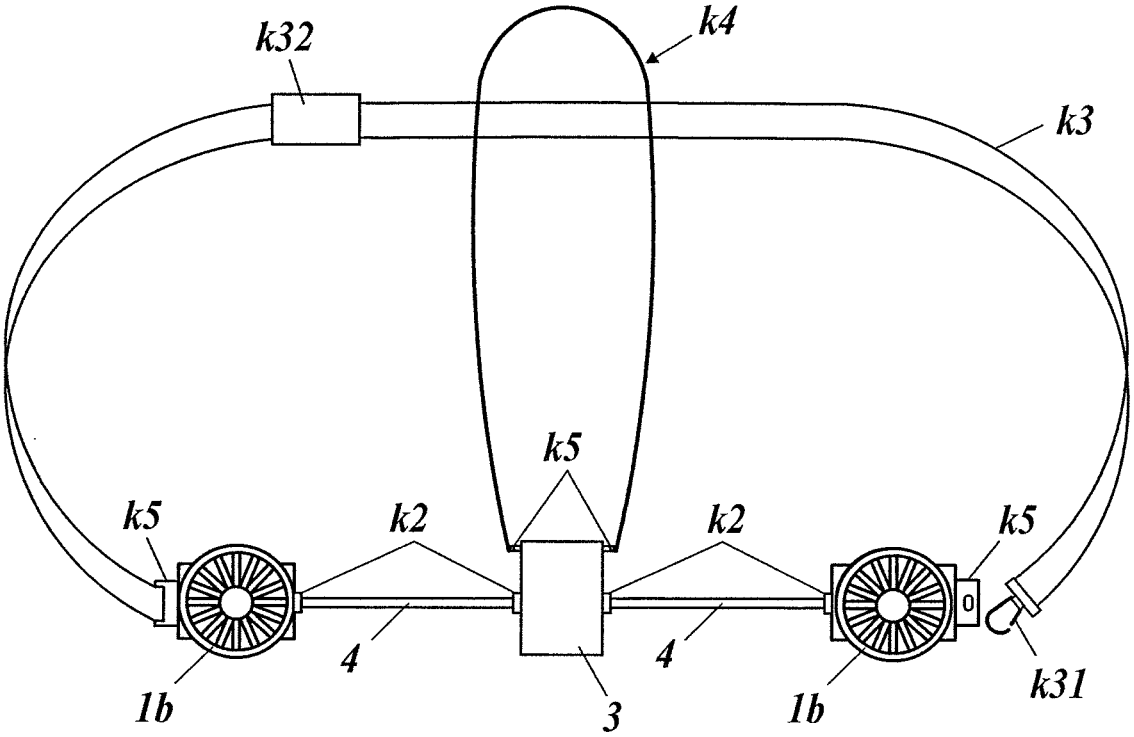
FIG. 12 is an overall front view of an air-conditioning unit according to the second embodiment.

FIG. 12 is an overall front view of the air-conditioning unit. As illustrated in FIG. 12, the right and left fans 1*b* are electrically and mechanically connected to the power supply 3 by the power cables 4, and a hook k5 of the left fan 1*b* is connected to an end of the waist belt k3, and a hook k31 is formed at the other end of the waist belt k3 which can be connected to a hook k5 of the right fan 1*b*. Further, hooks k5 are formed at both sides of the power supply 3 which are connected to a neck belt k4.

Figure 13:
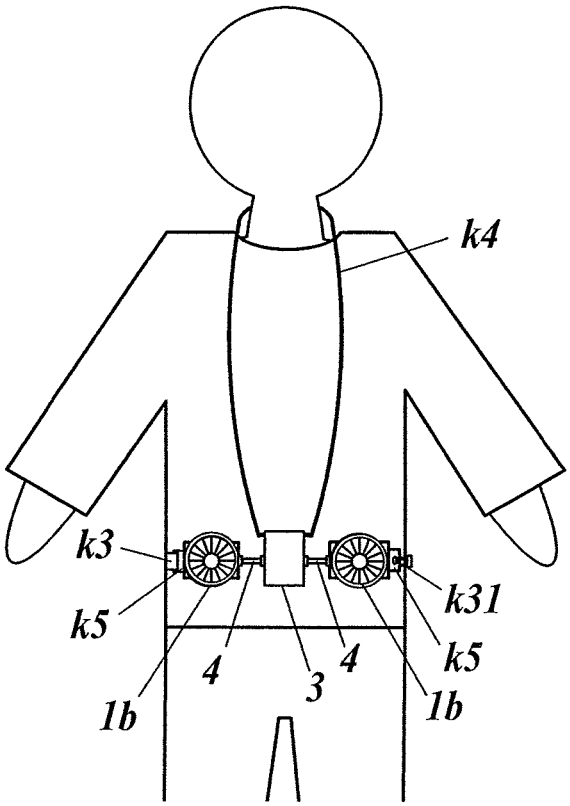
FIG. 13 is a schematic front view of the air-conditioning unit mounted on the body.

FIG. 13 is a schematic front view of the air-conditioning unit that is mounted on the body. As illustrated in FIG. 13, the neck belt k4 is hung on the neck, and the hook k31 of the waist belt k3 with an adjuster k32 is connected to the hook k5 of the right fan 1*b*, so that the air-conditioning unit is mounted on the body. The neck belt k4 can bear a part of the weight of the power supply 3. Needless to say, the neck belt k4 is not essential. Even when the weight of the power supply 3 is partly supported, it is not necessary to hang it on the neck. Instead, a variety of techniques can be employed such as supporting it with the cloth.

As illustrated in FIG. 13, when the air-conditioning unit is worn, the electric components, i.e. the fans 1*b*, the power cables 4 and the power supply 3, themselves serve as apart of the belt body 21. Further, since the power cables 4 are connected to the fans 1*b* and the power supply 3 by the technique as illustrated in FIG. 11, the connection is not broken even when the air-conditioning unit is subjected to a considerable force. To release the connection, the user can pinch and pull the fitting springs k12 with the fingers. The parts of the power supply 3 that are connected to the power cables 4, which are around the right and left terminals k21, can be regarded as power supply attacher 31. The parts of the fans 1*b* that are connected to the power cable 4, which are around the terminals k11, and the hooks k5 of the fans 1*b* can be regarded as fan attacher 15.

Figure 14:
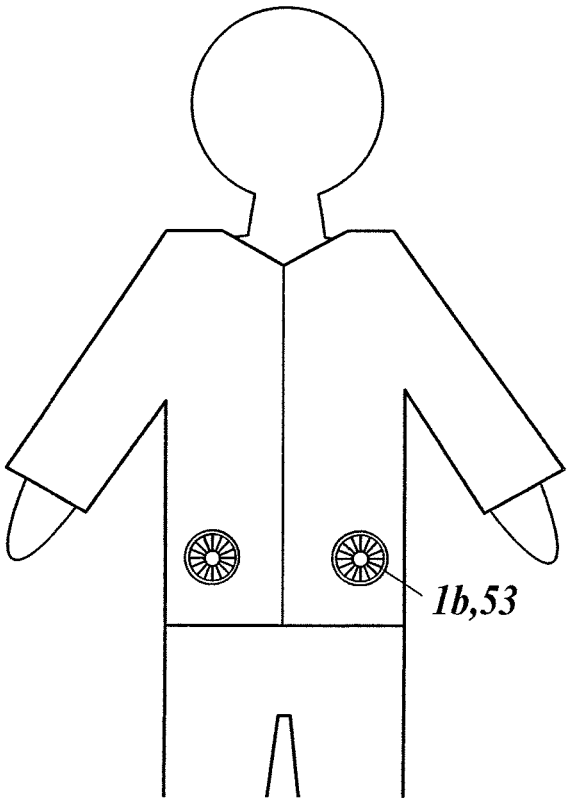
FIG. 14 is a schematic view of garment worn on the body in which fans are linked to fan openings.

FIG. 14 is a schematic view of garment worn on a user and the fans 1*b* and the fan openings 53 that are connected to each other. The technique of linking the fans 1*b* to the fan openings 53 is the same as that of the first embodiment.

Third Embodiment

A third embodiment is a large electric component mounting unit 100*b* for air-conditioned garment with a single large fan having large air volume and long continuous operation time.

Figure 15A:
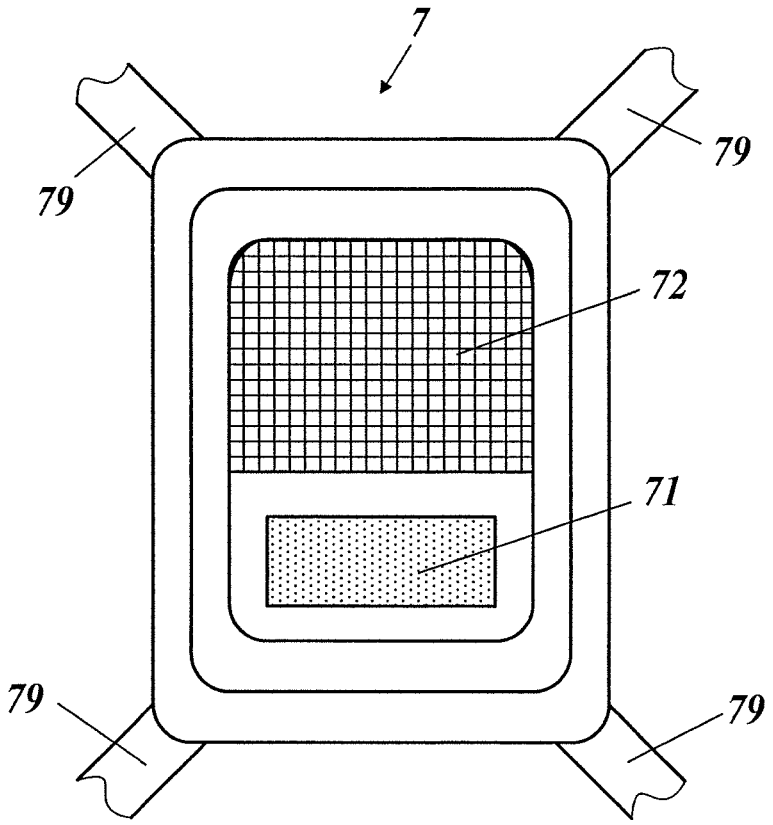
FIG. 15A is a schematic front view of an example of a unit according to a third embodiment in which a fan is integrated with a power supply.
Figure 15B:
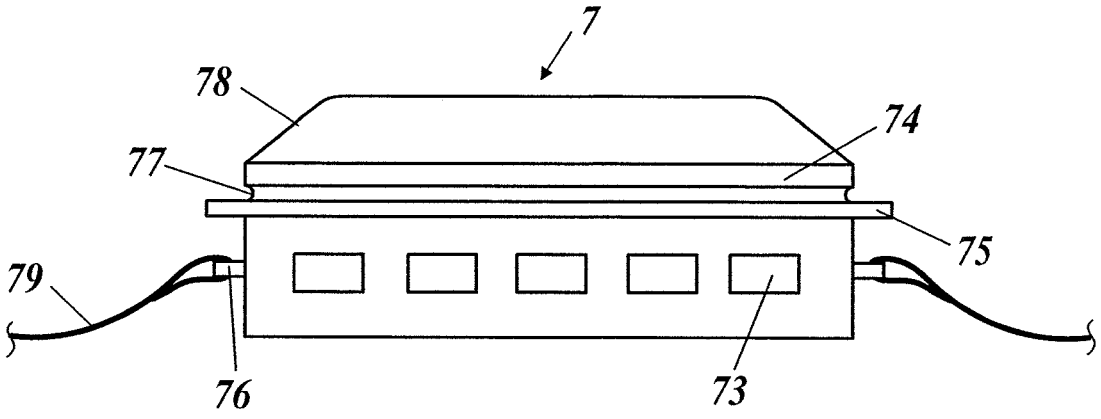
FIG. 15B is a schematic side view of the example of the unit according to the third embodiment in which the fan is integrated with the power supply.

FIG. 15A and FIG. 15B are a schematic front view and a schematic side view of a unit 7 with a large fan and a large power supply according to the third embodiment.

In the unit 7, the large fan (not shown) and the large capacity power supply 71 are integrally housed. The unit 7 includes an air inlet 72, an air outlet 73, a cylindrical linker 74, a flange 75, a unit fixture 76 (described below), a ring groove 77 and an inclined guide 78.

The large fan (not shown) and the large capacity power supply 71 are housed in a cover. In the cover, the air inlet 72 is formed in a top surface, and the air outlet 73 is formed in a side surface of the cover at a part lower than the center.

The flange 75 is formed at the center part of the side surface of the cover, and the cylindrical linker 74 is disposed above the flange 75. The cylindrical linker 74 can be regarded as a fan-side linker. The groove 77 is formed in the outer peripheral face of the cylindrical linker 74 near the flange 75. The inclined guide 78 is provided at an upper end of the cylindrical linker 74, which has a tapered shape with an outer periphery decreasing toward the upper end.

The unit fixture 76 (e.g. hooks formed at the four corners) is formed in the side surface of the cover at a part lower than the center, which are connected to four-pronged belts 79.

The fan and the power supply 71 may have any configuration with regard to the arrangement in the unit 7 and the like, and the unit 7 itself can be regarded as the fan that is integrated with the power supply 71. The unit 7, which includes the air inlet 72, the air outlet 73, the cylindrical linker 74, the flange 75 and the unit fixture 76 corresponding to a fan attacher as described above, has the same basic outer structure as the fans of the first and second embodiments. In the following description, the fans 1, 1*a*, 1*b* of the first and second embodiments and the unit 7 of the third embodiment are also referred to as a fan apparatus. Similarly, an opening for a fan apparatus is referred to as a fan opening 53.

The inclined guide 78 is provided so that a fan opening 53 of a garment body 5*c* can be easily linked to the cylindrical linker 74 of the unit 7, which will be described later.

Figure 16:
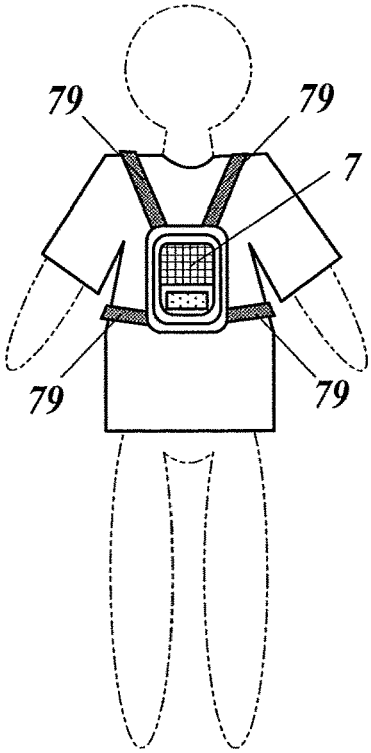
FIG. 16 is a schematic back view of the unit mounted on the back.
Figure 17:
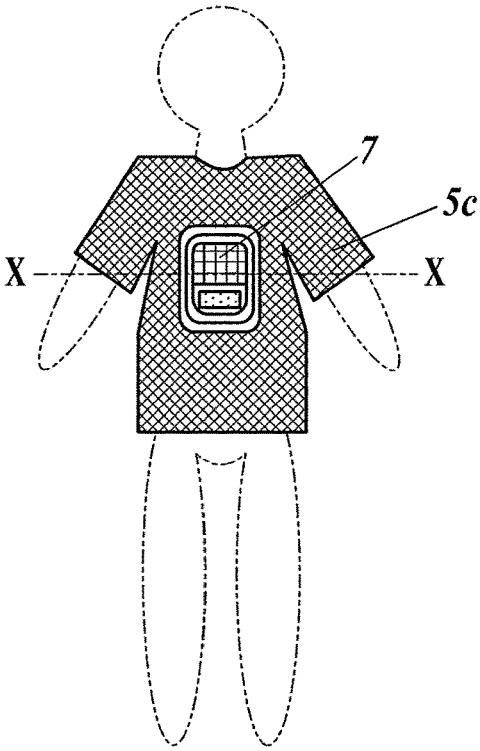
FIG. 17 is a schematic back view of the unit mounted on the back and a garment body worn on the body.
Figure 18:
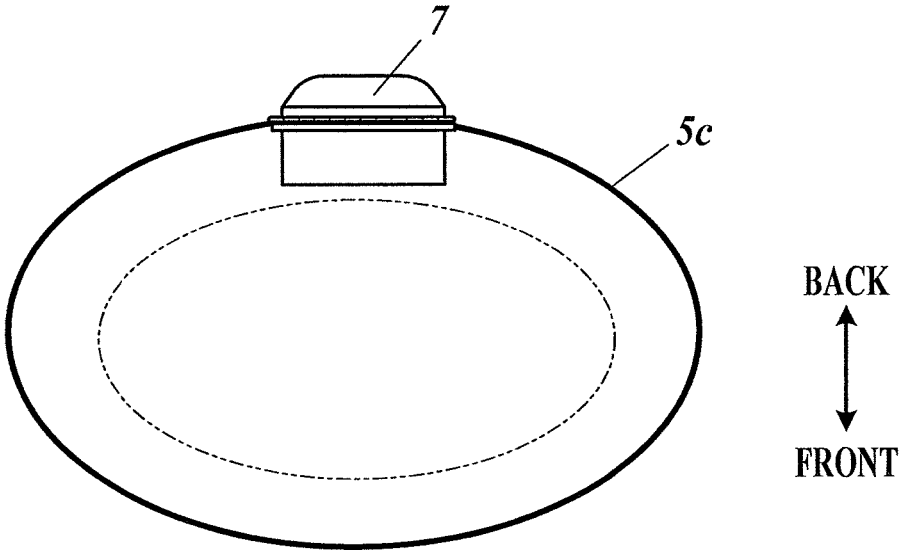
FIG. 18 is a schematic cross-sectional view of the unit mounted on the back and the garment body worn on the body.

FIG. 16 is a schematic back view of the unit 7 mounted on the back, FIG. 17 is a schematic back view in which the garment body 5*c* with the large fan opening on a back part is further worn, and FIG. 18 is a schematic cross-sectional view taken along the line X-X in FIG. 17, The garment body 5*c*, which is a jacket, has the fan opening (not shown) with a stretchable elastic ring at the edge in a position corresponding to the unit 7.

Next, a procedure for use will be described.

First, a user wears the unit 7 on his/her back like a school backpack. He/she then wears the garment body 5*c* over the unit 7, puts in his/her arms and pulls both sides of the garment-body 5*c* forward. Then, the edge of the fan opening of the garment body 5*c* is guided by the inclined guide 78 of the unit 7 to fit in the ring groove 77 formed above the flange 75 so that the body portion (cylindrical linker 74) of the unit 7 is linked to the fan opening. The unit 7 may be mounted on the chest or the abdomen similarly instead of the back.

To control the air volume and the like, a controller (not shown) connected to the unit 7 by a cable may be used. Alternatively, a remote or the like may be used for the control.

In the third embodiment, the unit 7 is heavy particularly since the power supply 71 has large capacity. However, since the unit 7 is worn on the back like a school backpack, the user does not feel the weight very much even when the capacity is considerably large. Therefore, the unit 7 is very suitable for a long and hard work.

In the third embodiment, explosion proofness may be achievable by confining the motor and the power supply 71 in a hermetic container and improving the airtightness between a rotation shaft and a bearing for attaching a fan blade to a motor.

It is not necessary to provide the cylindrical linker 74 all over the side surface of the unit 7. It may be partly provided corresponding to the air inlet 72.

Partly providing the cylindrical linker 74 can reduce the size of the fan opening 53. Further, it is not necessary to house the power supply in the cover. It may be hung below the cover or disposed above the cover. In such cases, the hanging structure itself can be regarded as a power supply fixture. Disposing the fan and the power supply in the unit 7 requires some sort of fixture or housing means, which is regarded as a fan fixture and a power supply attacher.

The usage is not limited to mounting the unit 7 and thereafter wearing the garment and linking the fan opening 53 to the body portion of the unit 7. Instead, the fan opening 53 may be linked to the body portion of the unit 7 beforehand, and the user may put on the unit 7 that is attached to the garment body 5*c* and thereafter put his/her arms in the sleeves of the garment body 5*c* to wear the garment body 5*c*.

Variation

Figure 19A:
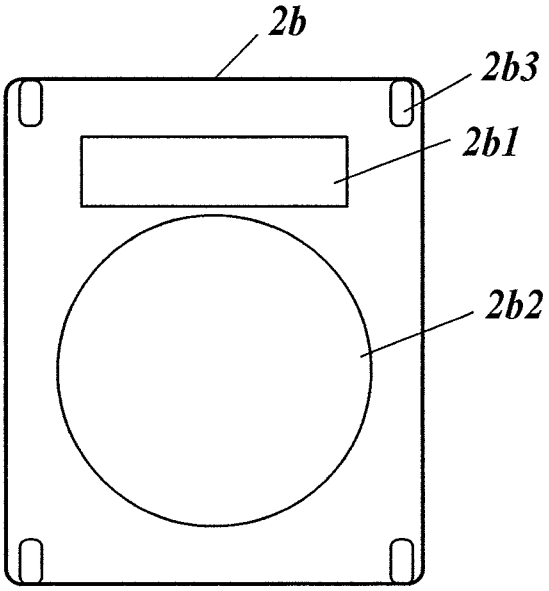
FIG. 19A is a schematic front view of an electric component mounting plate, which is a mounter according to a variation.
Figure 19B:
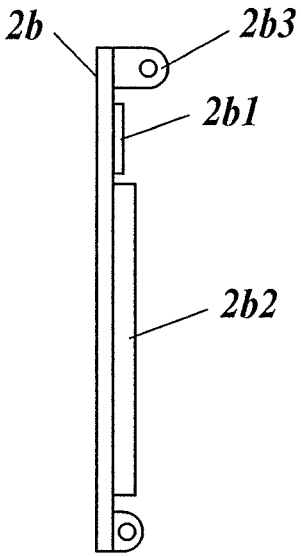
FIG. 19B is a schematic side view of the electric component mounting plate, which is the mounter according to the variation.

FIG. 19A is a schematic front view of an electric component mounting plate 2*b*, which is a part of a mounter, and FIG. 19B is a schematic side view thereof. As illustrated in FIG. 19, a vital sensor (not shown) is provided on a bottom surface of the electric component mounting plate 2*b* to measure body temperature and pulse, and a circuit board 2*b*1 is provided on a front surface. Further, a fan attacher 2*b*2 is formed for detachably attaching a fan, and hooks 2*b*3 are formed at four corners for attaching a back belt 79.

Figure 20:
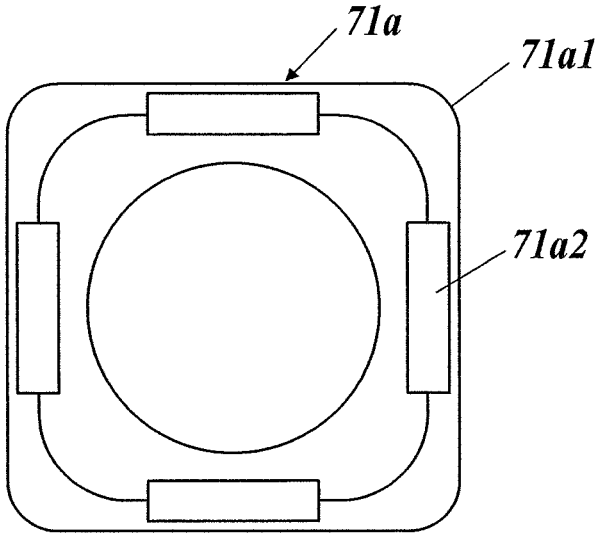
FIG. 20 is a schematic front view of the power supply.
Figure 21:
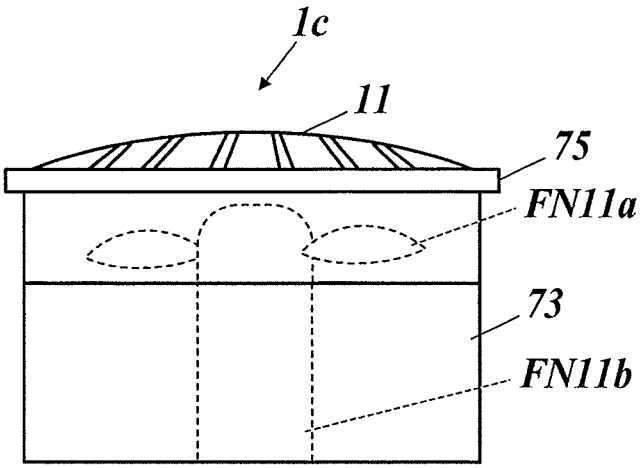
FIG. 21 is a schematic side view of the fan.
Figure 22:
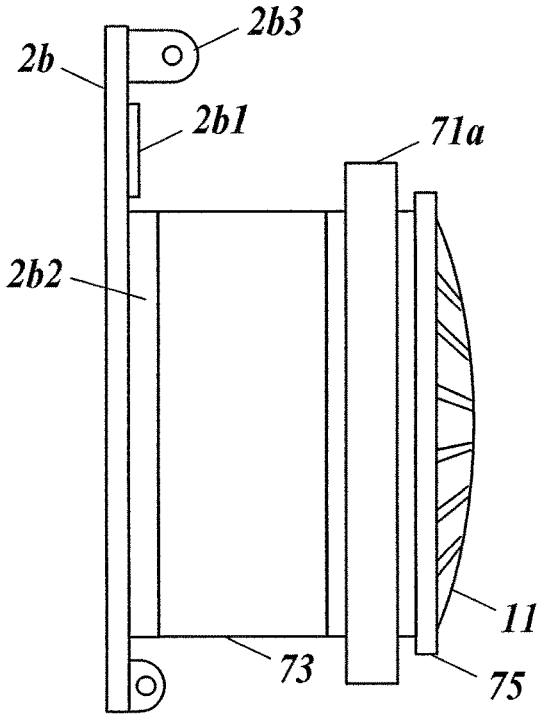
FIG. 22 is a schematic side view of the unit in which the fan with the power supply is attached to the electric component mounting plate.

FIG. 20 is a schematic front view of a power supply. FIG. 21 is a schematic side view of the fan. FIG. 22 is a schematic side view of a unit in which the fan with the power supply is attached to the electric component mounting plate 2*b*.

In the variation, the power supply 71*a* is constituted by four lithium-ion batteries 71*a*2 that are disposed in a container 71*a*1 having a rectangular frame shape, which is attached to a side surface of the fan 1*c* as illustrated in FIG. 20. The power supply 71*a* has a circular inner edge that contacts the cylindrical portion of the fan 1*c*. Like the relationship between a fan and an attaching ring of conventional air-conditioned garment (see JP 2015-065998A), the power supply 71*a* serves as an attaching ring, and the fan opening is held between a lower surface of a flange 75 of the fan 1*c* and an upper surface of the power supply 71*a*. The fan 1*c* is fixed on the electric component mounting plate 2*b* by a fan attacher, and the fan opening is not subjected to a load. The structure of the power supply 71*a* for attaching the power supply 71*a* to the fan is itself serves as a power supply attacher. It is meaningful to form the power supply 71*a* in a rectangular frame shape and to attach it on a cylindrical portion that surrounds a fan blade FN11*a* since the power supply 71*a* does not interrupt air flow from an air outlet 73 and an attaching space is secured.

Next, electric connection in the unit will be described. Two electrodes (not shown) are disposed at the part of the cylindrical portion of the fan 1*c* to which the power supply 71*a* is attached. When the power supply 71*a* is attached to the fan 1*c*, two electrodes (not shown) of the power supply 71*a* come in contact with the electrodes at the cylindrical portions, so that the power supply 71*a* is connected to power supply bottom electrodes (not shown) disposed on a bottom of the fan 1*c* via a duplex power cable (not shown) attached to the fan 1*c*. Further, a motor FN11*b* is connected to motor bottom electrodes (not shown) by a duplex power cable (not shown).

When the fan 1*c* with the power supply 71*a* is attached to the electric component mounting plate 2*b*, the power supply bottom electrodes and the fan bottom electrodes come in contact with corresponding electrodes (not shown) disposed on the circuit board so that the electric power from the power supply 71*a* is converted to a suitable voltage by a circuit provided on the circuit board 2*b*1 and then applied to the motor FN11*b*.

Figure 23:
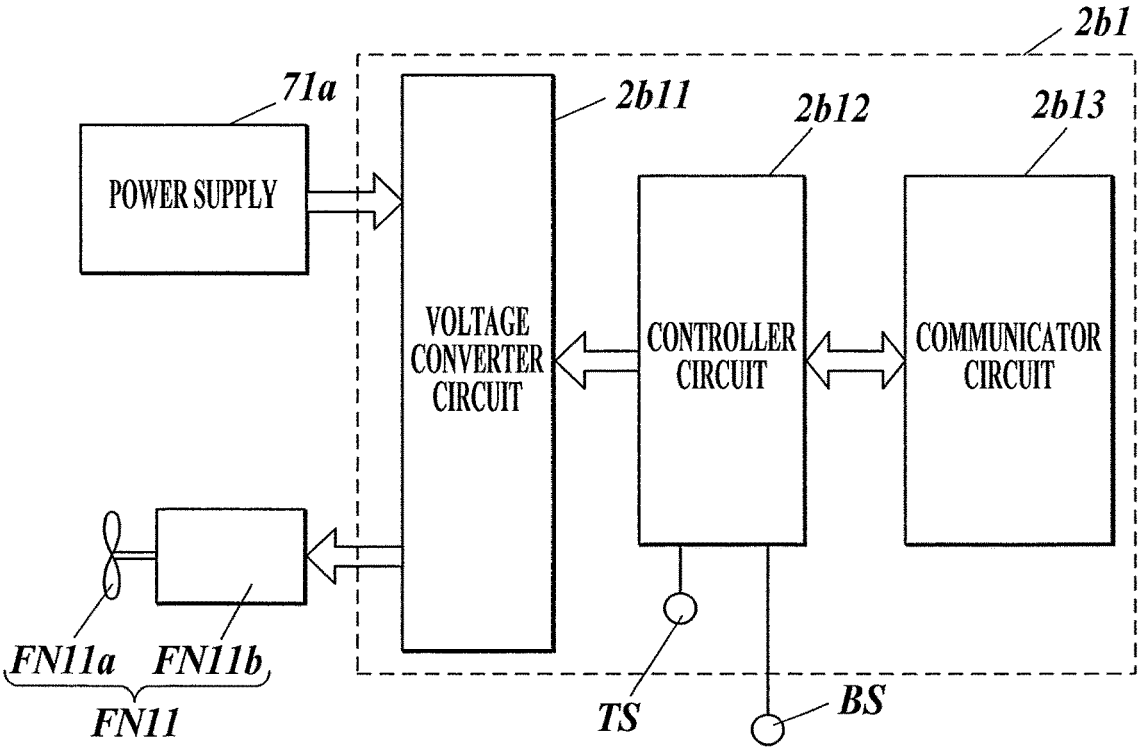
FIG. 23 is a circuit diagram of the unit according to a variation of the third embodiment.

FIG. 23 is a circuit block diagram. The circuit board 2*b*1 includes a voltage converter circuit 2*b*11 for converting the voltage of the power supply 71*a* and applying it to the motor FN11*b* of the fan 1*c* based on an instruction of a controller circuit 2*b*12 and a communicator circuit 2*b*13 that sends information from the vital sensor BS, a temperature and humidity sensor TS, etc. to an external communication device (not shown) such as a smartphone and receives an instruction from the external communication device. That is, a suitable voltage is supplied to the motor FN11*b* based on the temperature and the humidity of the taken air and the data from the vital sensor BS. Alternatively, a suitable voltage can be applied to the motor FN11*b* based on an instruction from the outside.

Figure 24A:
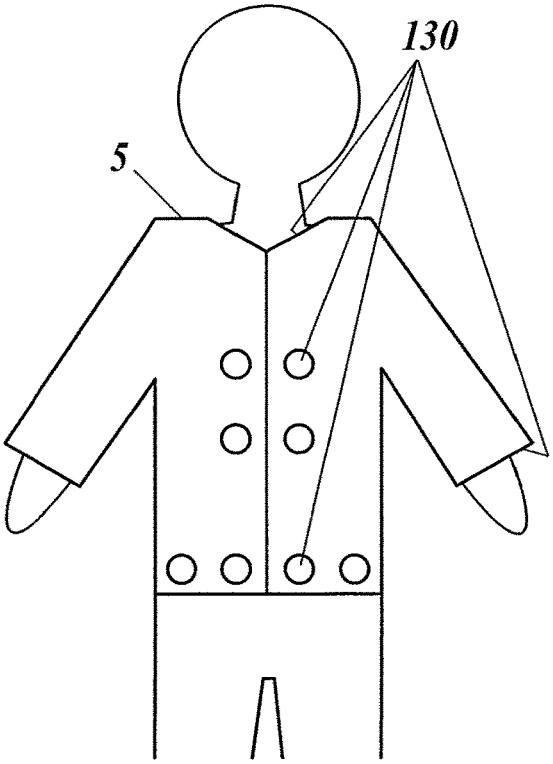
FIG. 24A is a schematic front view of an air-conditioned garment according to the variation worn on the body.
Figure 24B:
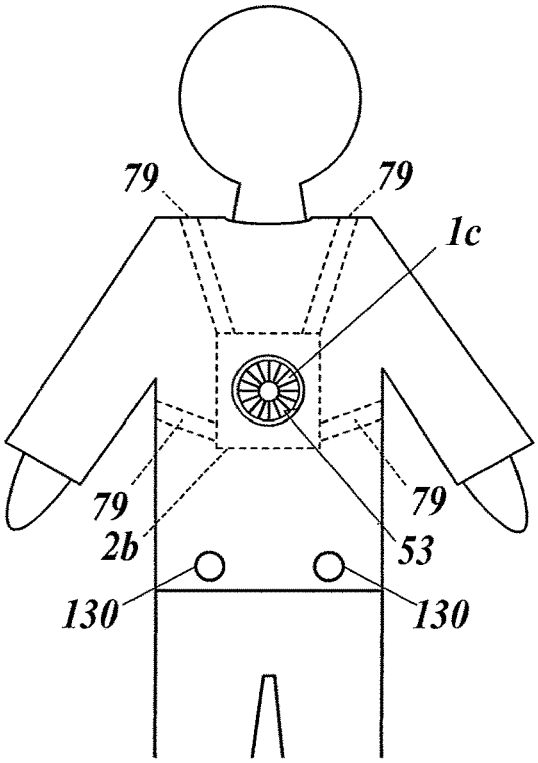
FIG. 24B is a schematic back view of the air-conditioned garment according to the variation worn on the body.

Next, an example procedure of wearing the air-conditioned garment of the variation will be described. FIG. 24A is a schematic front view of the air-conditioned garment of the variation worn on the body, and FIG. 24B is a schematic back view thereof. The fan opening 53 is formed at a back part of the air-conditioned garment body, and air discharging portions 130 are provided at various parts of the garment body 5 as well as a neck part and arm parts as illustrated in FIG. 24. A belt 79 is attached to the electric component mounting plate 2*b* beforehand.

1. Insert the fan is into the fan opening 53 from the outer side.

2. Fit the power supply 71*a* on the body portion of the fan is from the inner side of the garment body 5 such that the edge of the fan opening 53 is tucked in.

3. Fixedly attach the fan 1*c* with the power supply 71*a* to the electric component mounting plate 2*b*. The unit with the belt 79 and the garment body 5 is thus completed.

4. Wear the unit on the back.

5. Put in the arms to wear the garment and close the zipper.

Next, a usage will be described. A relevant software is installed in a smartphone as the external communication device.

When the air-conditioned garment is activated with the smartphone, data is output and sent from the temperature and humidity sensor TS and the vital sensor BS to the smartphone. Air volume data calculated from the data is then sent to the unit, and the voltage converter circuit 2*b*11 applies an electric power to the motor FN11*b* of the fan 1*c* by a control of the controller circuit 2*b*12 based on the received air volume data.

In the variation, a normal finger guard is attached on the air inlet of the fan. Instead of the finger guard, a variety of optional parts as illustrated in FIG. 25A, FIG. 25B and FIG. 25C may be attached.

Figure 25A:
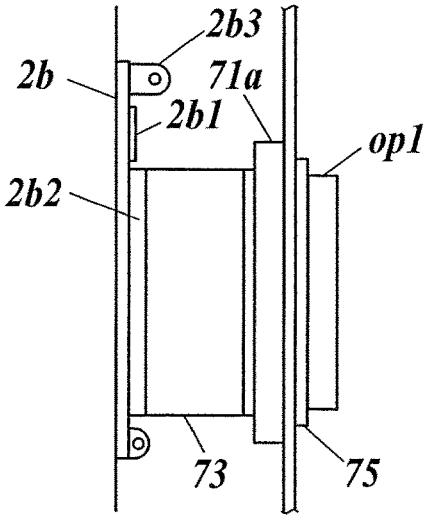
FIG. 25A is a schematic side view of a unit according to a fourth embodiment, to which an optional container is attached for the same purpose as a filter or a water-bearing sponge.

FIG. 25A illustrates an optional container OP1 that is used for the same purpose as the filter or the water-bearing sponge of the fourth embodiment.

Figure 25B:
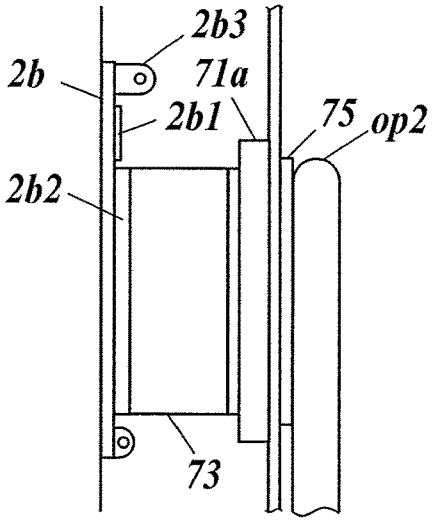

FIG. 25B is a rain cover OP2 that allows taking the outside air from a lower side so that rain does not get in.

Figure 25C:
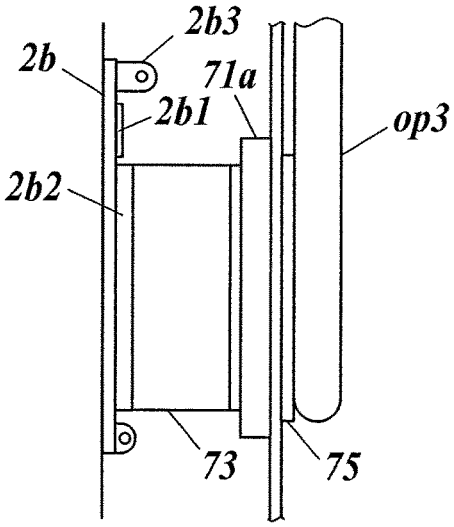
FIG. 25C is a schematic side view of the unit to which a container for storing dry ice pellets (coolant) or the like is attached.

FIG. 25C is a container OP3 for storing dry ice pellet (coolant) or the like.

As described above, the simple finger guard can be changed to a container or the like according to an intended use. Further, since the unit is worn on the back, it does not put a large burden even when the weight of the container and the content thereof is considerably heavy.

Fourth Embodiment

Figure 26:
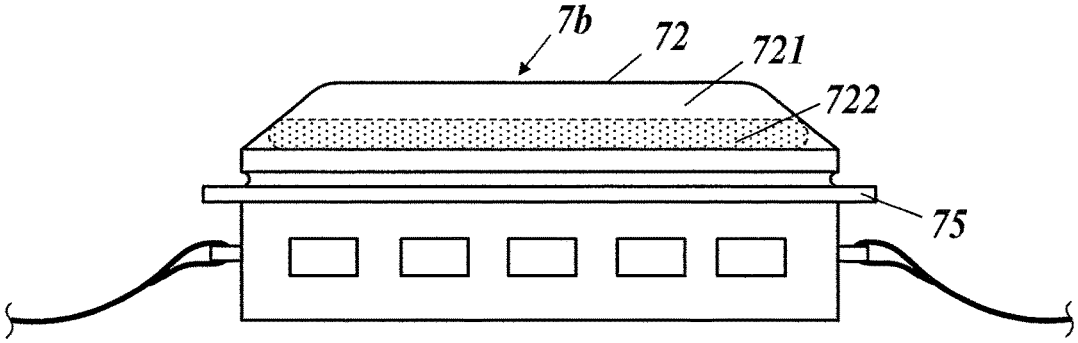
FIG. 26 is a schematic cross-sectional view of the unit according to the fourth embodiment.

FIG. 26 is a schematic cross-sectional view of a unit 7*b* according to a fourth embodiment.

An air-conditioned garment of the embodiment includes the unit 7*b* as with the third embodiment 3. The difference from the third embodiment is that an air inlet 72 expands over the entire upper surface of the unit 7*b*, a functional space 721 for attaching a dust filer 722 is defined immediately below the air inlet, and the filter 722 is housed therein as illustrated in FIG. 26. In the embodiment, the taken air is purified by removing dust and the like with the filter 722 and then taken into the garment body.

Variation

An air-conditioned garment according to this variation is intended to be used in an environment with very high outside temperature and the dry air in which the air-conditioned garment does not work only by the heat of vaporization of sweat. This variation is a special air-conditioned garment that cools the air to be taken into the air-conditioned garment by the heat of vaporization of water.

Figure 27:
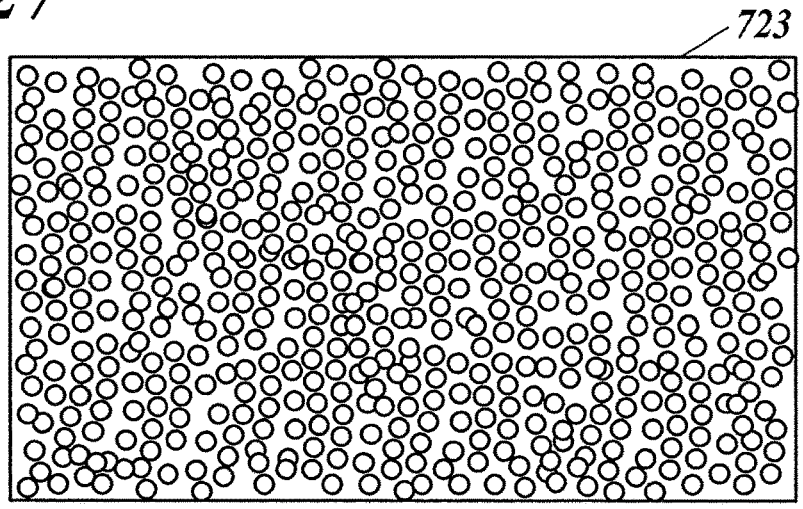
FIG. 27 is a schematic front view of the water-bearing sponge.

FIG. 27 is a schematic front view of a water-bearing sponge 723 that serves as a water bearing means.

This variation is different from the fourth embodiment in that the water-bearing sponge 723 is housed in the functional space 721 instead of the filter 722. For example, the water-bearing sponge 723 is a 1-cm thick high water-absorptive sponge having 2 φ pores all over the surface at an open rate of 50%. When the wet water-bearing sponge 723 is housed in the functional space 721, the air is taken in through the 2 φ pores while a lot of water is evaporated to cool the air by the heat of vaporization, and the cooled air is introduced into the air-conditioned garment.

The method of using water and cooling the air by the heat of vaporization of water is not limited to using the wet sponge. For example, a mist generator may be provided in the functional space so that mist is taken into the air-conditioned garment. In this case, a water container may be disposed either in the functional space or outside.

In the third and fourth embodiments and the variations thereof, dust is removed with a filter, or the air is cooled by the heat of vaporization of water. According to need, various types of filters may be used to remove a specific substance or a harmful substance, or the sponge may be impregnated with a deodorant or a perfume. Further, a substance good for health may be taken into the garment by other various methods.

As illustrated in the third and fourth embodiments and the variations thereof, a variety of techniques can be used according to need for an air improver for improving the air to be taken into the garment (preventing rain from getting in is also an improvement of the air). The air improver is not limited to those disposed on an outer side of the fan for improving the air to be taken by the fan as in the embodiments. The air that has taken in by the fan may also be improved. Accordingly, the air improver is disposed around the air inlet of the fan.

As described above, it is possible to completely prevent the electric components from coming off by fixing the electric components on the mounter. Further, this also allows increasing the size or imparting a functionality, which is difficult in conventional air-conditioned garment in which a fan is attached to garment. Since the unit is in close contact with the body, it is possible to readily attach a sensor for maintaining health (body surface temperature, pulse and the like). Further, the data can be sent to a work manager to detect a worker in poor health.

Fifth Embodiment

Next, an electric component mounting unit for air-conditioned garment (air-conditioning unit) according to a fifth embodiment will be described. The electric component mounting unit for air-conditioned garment of this embodiment includes an electric component attaching belt (mounter) 2 and fans 1*d* attached to the electric component attaching belt 2. That is, compared to the electric component mounting unit for air-conditioned garment of the first embodiment, in which the power supply and the power cables are attached to the electric component attaching belt 2 as well as the fans, this embodiment is different in that the fans are the only electric components that are attached to the electric component attaching belt 2.

Figure 28:
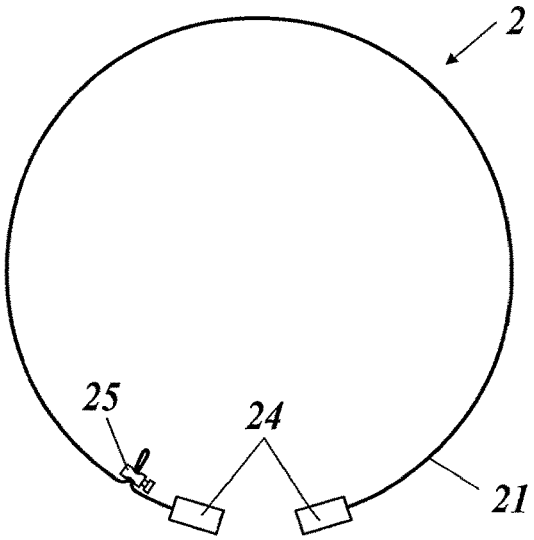
FIG. 28 is a schematic view of an electric component attaching belt of an electric component mounting unit for air-conditioned garment according to a fifth embodiment.

FIG. 28 is a schematic view of the electric component attaching belt 2 of the electric component mounting unit for air-conditioned garment according to the fifth embodiment. As illustrated in FIG. 28, the electric component attaching belt 2 of the embodiment includes a belt body 21, a pair of connecting terminals 24 to be connected to each other and a cord lock (length adjuster) 25. The belt 22, which is a main component of the belt body 21 of the embodiment, is constituted by a non-elastic single cord. The pair of connecting terminals 24 is disposed at the ends of the cord. The cord lock 25 is provided to fix the cord at a desired length so as to adjust the length of the cord.

To mount the electric component attaching belt 2 of the embodiment on the waist, the cord or the belt body 21 is worn around the body, and the connecting terminals 24 are connected to each other.

Next, the fans 1*d* of the electric component mounting unit for air-conditioned garment of the embodiment will be described.

Figure 29A:
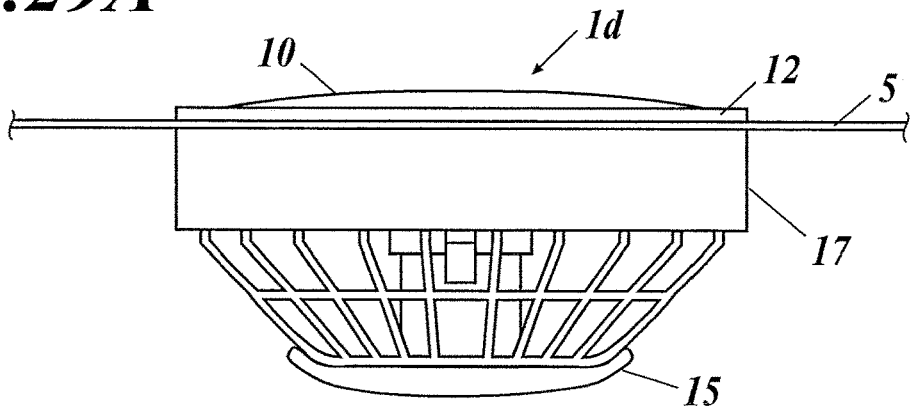
FIG. 29A is a schematic side view of a fan according to a fifth embodiment.
Figure 29B:
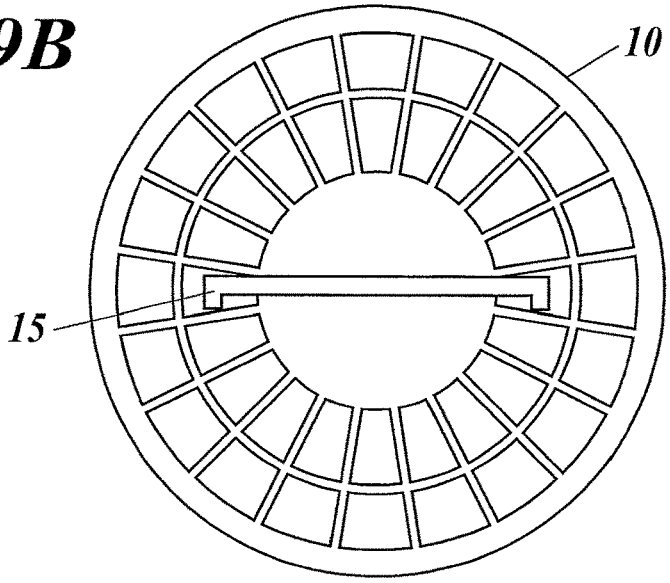
FIG. 29C is a schematic back view of the fan attached to a belt body.
Figure 29C:
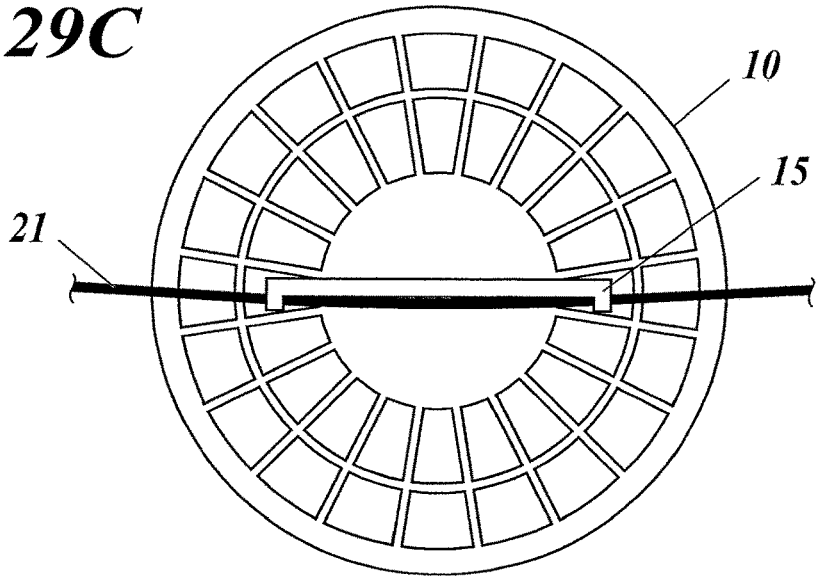

FIG. 29A is a schematic side view of a fan 1*d* of the embodiment, FIG. 29B is a schematic back view thereof, and FIG. 29C is a schematic back view of the fan 1*d* that is attached to the cord.

As illustrated in FIG. 29A to FIG. 29C, the fan 1*d* includes a main body 10 composed of a fan body and a cover for housing the fan body, a cylindrical attaching cylinder 17 that is detachably attached to the main body 10 and a fan attacher 15 for slidably attaching the fan to the above-described cord. The attaching cylinder 17 is provided to fix the fan 1*d* that is attached to a fan opening 53 of a garment body 5. Specifically, as illustrated in FIG. 29A, the attaching cylinder 17 is attached to the main body 10 to cover the side surface of the main body 10 so that the edge of the fan opening 53 is held between a flange 12 at an upper part of the main body 10 and the attaching cylinder 17. The fan 1*d* is thus fixed to the fan opening 53.

The fan attacher 15, which is disposed at a lower part of the main body 10, includes Ω-shaped metal fittings (not shown) having a spring characteristic at contacting ends. The metal fittings are configured such that they can be readily manually attached or detached to a cord in a slidable manner but does not readily detach on their own. Accordingly, the fan attacher 15 is attached to the electric component attaching belt 2 in a movable manner in the longitudinal direction of the cord. Further, the fan attacher 15 is attached to the electric component attaching belt 2 in a slidable manner on the electric component attaching belt 2. Since this structure of the fan attacher 15 can be readily achieved by a variety of methods using the spring characteristic of the metal fittings, the detail description thereof is omitted. Instead of the metal fittings, Ω-shaped plastic molded parts having a spring characteristic may be used.

Figure 30:
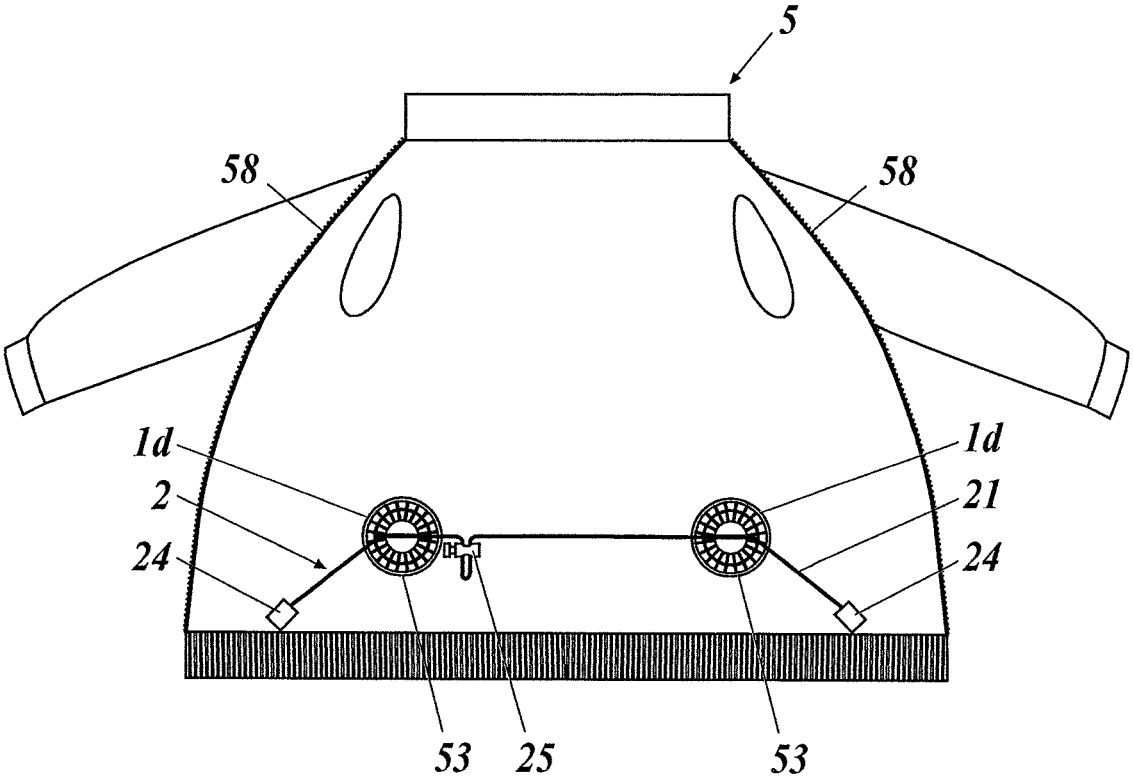
FIG. 30 is a schematic front view of the air-conditioned garment with the front part open, to which the electric component mounting unit for air-conditioned garment according to the fifth embodiment is attached.

Next, a usage of air-conditioned garment with the electric component mounting unit for air-conditioned garment of the embodiment is described. FIG. 30 is a schematic front view of the air-conditioned garment with the front part open, to which the electric component mounting unit for air-conditioned garment of the embodiment is attached.

First, the two fans 1*d*, 1*d* are attached to the fan openings 53 of the garment body 5. As described above, the edges of the fan openings 53 are held between the flanges 12 at the upper parts of the main bodies 10 and the attaching cylinders 17 so that the fans 1*d* are fixed to the fan openings 53. That is, the flanges 12 and the attaching cylinders 17 of the fans 1*d* serve as fan-side linkers. The attaching method is disclosed in detail in Japanese patent application No. 2016-508371, and the description thereof is omitted.

Then, the fans 1*d* is connected to a power supply (not shown) by power cables (not shown).

Then, as illustrated in FIG. 29C and FIG. 30, the cord is attached to the fan attacher 15 of the fans 1*d*, and the garment body 5 is worn. The pair of connecting terminals 24 of the cord is connected to each other so that the electric component attaching belt 2 is mounted around the waist. In this step, the length of the cord is adjusted with the cord lock 25 according to need.

Then, a zipper 58 at the front part of the garment body 5 is closed. The fans 1*d* are driven to take the outside air into the garment.

Sixth Embodiment

Next, an air-conditioned garment according to a sixth embodiment will be described.

Figure 31A:
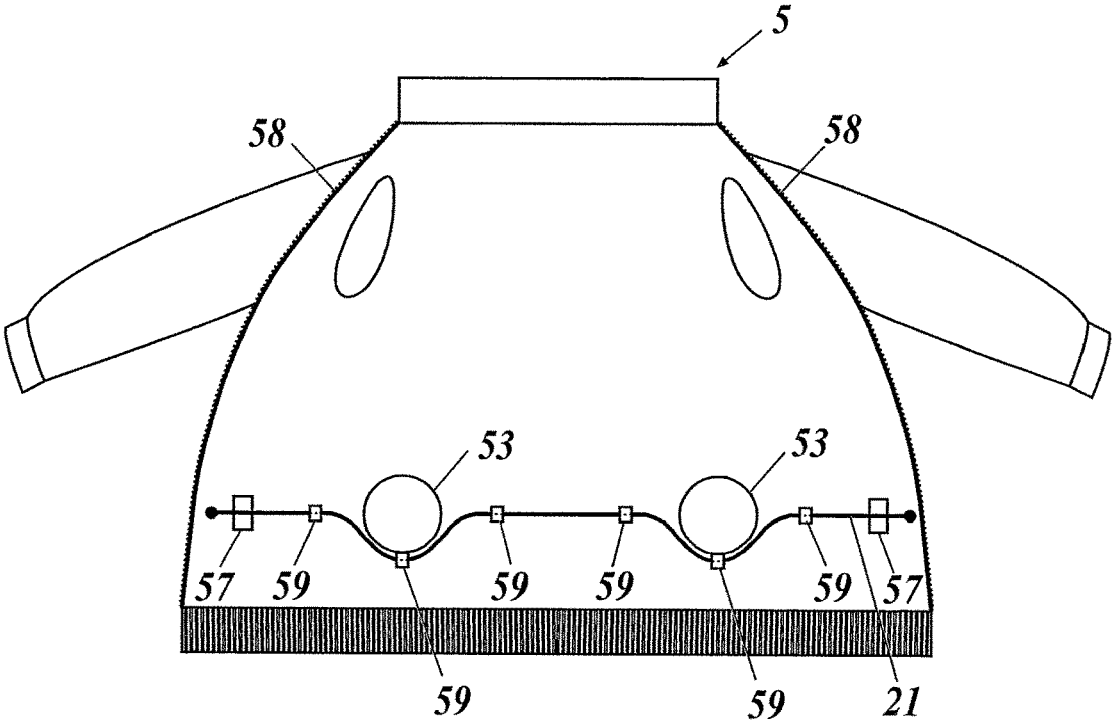
FIG. 31A illustrates an air-conditioned garment according to a sixth embodiment, which is a schematic front view of a garment body.
Figure 31B:
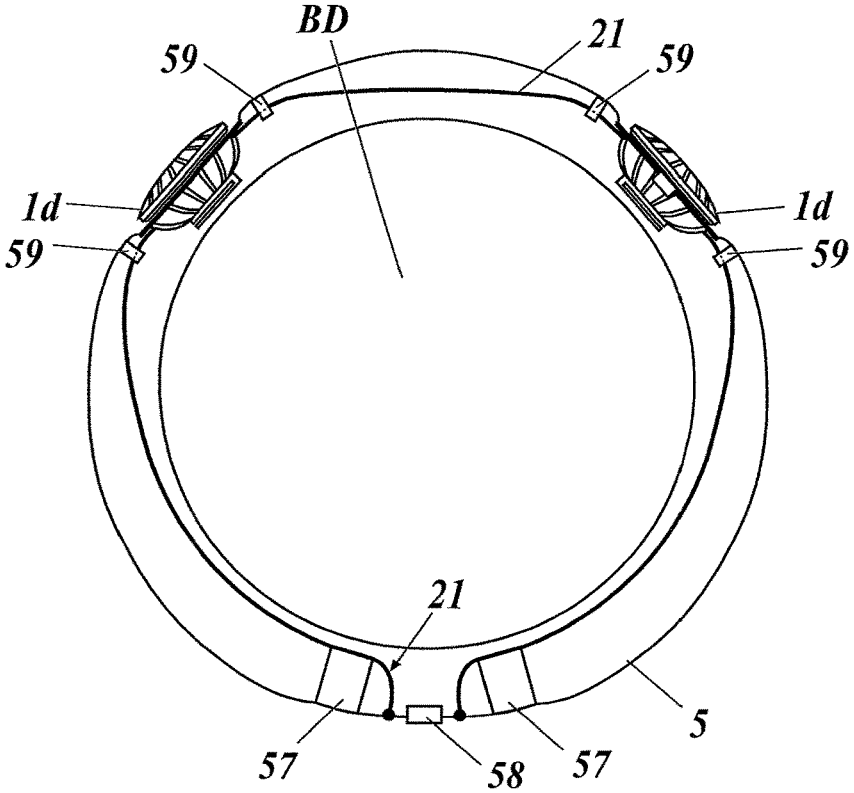
FIG. 31B illustrates the air-conditioned garment according to the sixth embodiment, which is a schematic cross-sectional view of the garment body worn on the body and fans attached thereto taken in the part where the fans are attached.

FIG. 31A is a schematic front view of a garment body 5 of air-conditioned garment according to this embodiment, and FIG. 31B is a schematic cross-sectional view of the garment body 5 with fans 1*d* that is worn on the body, taken at the waist where the fans 1*d* are mounted.

In the fifth embodiment, metal fittings as the fan attacher 15 are provided at the right and left sides of the main bodies 10 of the fans 1*d*, and the cord is put through the metal fittings. In contrast, in this embodiment, cord guides 59 are provided to a cloth 51 near the right and left sides of fans 1*d* instead of providing metal fittings to the fans 1*d*, and a single cord (rubber cord) that serves as a main body of the belt 22 is put through the cord guides 59 as illustrated in FIG. 31A. Pillar portions of air outlets of the fans 1*d* are linked to the cord by hooks (not shown). The ends of the cord are sawn on near a zipper of the garment body 5 via gap securing means 57. That is, the cord does not directly make the fans 1*d* in close contact with the body, but it presses the fans 1*d* against the body in an approximately perpendicular direction via the cloth 51 so as to make the fans 1*d* in close contact with the body. That is, the cord is entirely incorporated in the garment, and it is possible to use conventional fans without any change.

With this configuration, the fans 1*d* come in close contact with the body when the zipper 58 of the garment body 5 is closed as illustrated in FIG. 31B. Further, since the fans 1*d* are pressed against the body (body BD), it is possible to reduce the force of tightening the cord around the body. When a rubber cord is used in all or a part of the cord, it is not always necessary to adjust the length of the cord since it can adapt to different body sizes.

The pillar portions of the air outlets of the fans 1*d* are linked to the cord by the hooks (not shown). This can prevent the fans 1*d* from falling when the fans 1*d* come off from the garment body 5. In this configuration, the fans 1*d* are linked to the cord via the hooks or the like, and the mechanism that links the fans 1*d* to the cord can be regarded as a fan attacher. The technique of attaching the fans 1*d* to the cord is not limited to the method using the hooks, and a variety of general techniques can be used.

As described above, in the electric component mounting unit for air-conditioned garment of the first, second, fifth or sixth embodiment, since the fans are attached to the electric component attaching belt mounted on the body of a user, the portion where the fans are attached does not billow when it is used with air-conditioned garment so that the pressure in the air-conditioned garment becomes positive. Therefore, a variety of problems that are caused by the billowing fan portion (e.g. disturbing a work of a user who wears the air-conditioned garment) can be avoided.

In conventional air-conditioned garment, fans are hung on a garment body. In contrast, the fans are in close contact with the body in the air-conditioned garment with the electric component mounting unit for air-conditioned garment of the embodiments, which produces the following advantageous effects.

1. Even when the fans are subjected to an external force, the fan apparatuses is not moved much since they are in close contact with the body. Since components in the fans are not subjected to a large impact force, it is possible to use inexpensive components that are not resistant to a large impact force. Further, since an external force applied, to the fans is absorbed by the body, it is possible to use an inexpensive material for the structural members of the fans.

2. It is only necessary to get the electric component mounting unit for air-conditioned garment, and a user's own cloth can be readily formed into the garment body of the air-conditioned garment. This can accelerate spread of the air-conditioned garment and promote realization of eco-friendly society.

In the fifth embodiment, a single non-stretchable cord is used as the belt body. Further, in the sixth embodiment, a single rubber cord is used. However, a plurality of cords, one or more bands, or a combination of one or more cords and one or more bands may be used as a part or all of the belt of the fifth or sixth embodiment. Particularly in the sixth embodiment, a variety of combinations may be employed. For example, the cord guides may be provided near the upper and lower sides of the fan openings, and two cords may be provided near the fans.

By using a rubber cord or the like in a part of all of the cord to impart elasticity, it is possible to omit the cord lock for adjusting the length of the cord.

The ends of the belt body may be attached near the zipper without using any connecting terminal. Instead of sewing, hooks or the like may be attached to the ends of the belt body, and engaging means that engages with the hooks or the like may be provided near the zipper, so that the belt body can be detachably attached to the garment body. The attaching position is not limited to the vicinity of the zipper but may be anywhere at least in the front part of the garment body. In this case, the portion from the part where one end of the cord is attached to the part where the other end of the cord is attached, including the zipper (fastener), can be regarded as a part of the belt body. When the ends of the cord are attached to the front part of the garment body, the fans are mounted by wearing the garment and closing the zipper.

Figure 32:
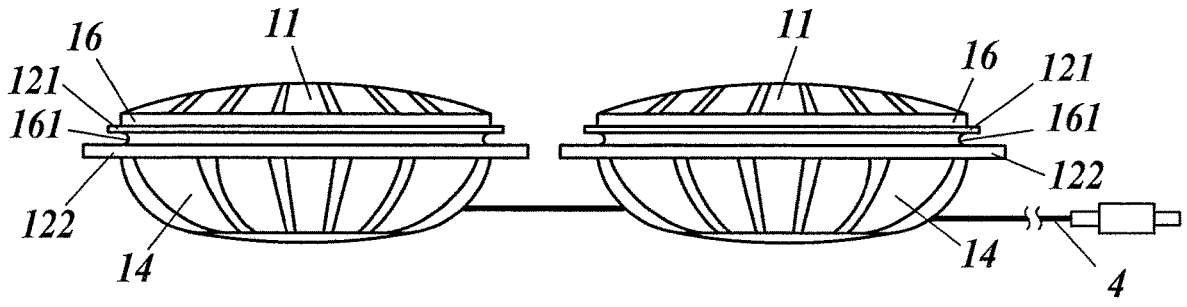
FIG. 32 is a schematic side view of an example of integrated fans and a power cable.

In the first, fifth or sixth embodiment, the fans can be attached to the fan openings from the inner side of the garment. Therefore, the fans and the power cables 4 may be directly connected and integrated with each other as illustrated in FIG. 32. Integrating the fans with the cables and eliminating terminals can eliminate the occurrence of bad connection and reduce the cost.

In third or fourth embodiment, the electric component mounting unit for air-conditioned garment and all electric components are integrated with each other as the unit. Further, in the first, second fifth and sixth embodiment, the fans are attached on the belt body of the mounter. Therefore, even when the fans come off from the garment body, they do not fall. Further, the fans are supported by the belt body. This can prevent the weight of the fans from being applied to the garment body, which can improve the comfort of the air-conditioned garment.

In the electric component mounting unit for air-conditioned garment of the fifth embodiment or the sixth embodiment, the fans are slidably attached on the belt. Even when the fan openings are misaligned, the fans can be readily attached to the fan openings by sliding the fans. In the fifth embodiment, it is possible to adjust the length of the electric component attaching belt since the cord lock is provided. Further, in the sixth embodiment, it is possible to closely contact the fans with the body at suitable pressure since the belt is elastic.

In the electric component mounting unit for air-conditioned garment according to any of the first to fifth embodiments, the garment body mainly made of a sheet material can be separated from the electric components that are made of completely different materials from the sheet material. Accordingly, it is not necessary to consider the relationship between the garment body and the electric components. Therefore, the garment body and the unit of the electric components can be reasonably designed and produced respectively as a garment article and an electric product. This allows reduction of the cost and improvement of the performance and the usability.

In the first and second embodiment, the electric components are mounted on the body by tightening the electric component attaching belt around the waist. Instead, for example, they may be mounted on the body by hanging them around the shoulder or the neck.

In the embodiments, the garment body is an upper garment that is worn on the upper body. The garment body may also cover the lower body like an overall or a winter coat. In this case, the air leakage preventing means at the sleeves is not always necessary.

Specific examples of the power supply that can be used include primary cells, secondary cells and fuel cells. When a solar cell (solar panel) is used, the solar panel cannot be housed in the power supply, but a means for utilizing or storing electricity generated by the solar panel corresponds to the power supply.

The shape of the fans is not limited to a circular shape. For example, the fans are not limited to a so-called propeller fan but may also be constituted by a multiblade fan (sirocco fan) or the like. Depending on the shape or the like of the fans, the air inlets are not limited to those with an opening in a top surface.

In the embodiments, two fans disposed at the right and left or a single large fan is used. However, the number of fans may be two or more.

A communicator may be provided in the power supply or the like, and the ON/OFF and/or the rotation speed of the fans may be controlled, for example, according to an instruction received from an application of an external apparatus such as a smartphone.

A measure for measuring a vital sign such as body temperature or pulse may be provided, and the ON/OFF and/or the rotation speed of the fans may be controlled based on a measurement result of the measure. Further, the communicator may be controlled to send a measurement result of the measure to the outside.

Figure 33:
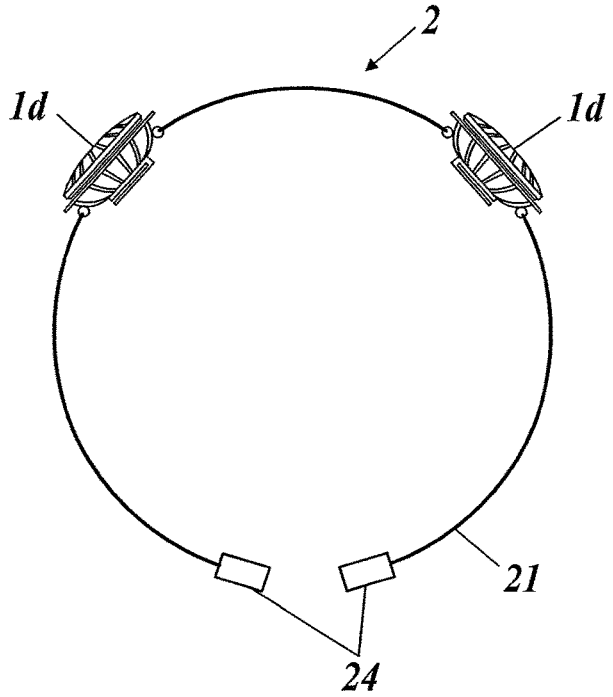
FIG. 33 is an explanatory view of another example of the electric component attaching belt.

Further, a measurement result of the measure may be sent to a smartphone, which is an external apparatus, and the ON/OFF and/or the rotation speed of the fans may be controlled according to an instruction of an application of a smartphone based on the measurement result The fifth embodiment and the sixth embodiment illustrate an example in which the fans 1*d* are slidably attached to the electric component attaching belt 2. However, it is not always necessary to slidably attach the fans 1*d*. For example, as illustrated in FIG. 33, cords of the belt body 21 may be tied to both sides of the fans 1*d* to constitute the electric component attaching belt 2. That is, the fans 1*d* can be regarded as a part of the electric component attaching belt 2 in this case.

The fifth embodiment illustrates an example in which the fans 1*d* are slidably attached to the electric component attaching belt 2. The method of attaching the fans 1*d* to the electric component attaching belt 2 in a slidable manner is not limited to those in the embodiments, and a variety of general methods can be employed instead.

The position of the fans 1*d* may be suitably changed. They may be disposed in the front part of the garment body 5 instead of the back part. In this case, the fans 1*b* do not disturb a user when he/she sits on a chair or a car seat. Further, a spacer disclosed in JP 4067034B may be disposed on an inner side of a back part of the garment to secure an air pathway between the garment and the back even when the user leans on aback of the chair.

The fifth embodiment and the sixth embodiment illustrate an example in which the fans are the only electric components attached to the electric component attaching belt 2. However, the power supply (power source), which is an electric component, may also be attached on the electric component attaching belt 2 in order to prevent it from falling.

Figure 34A:
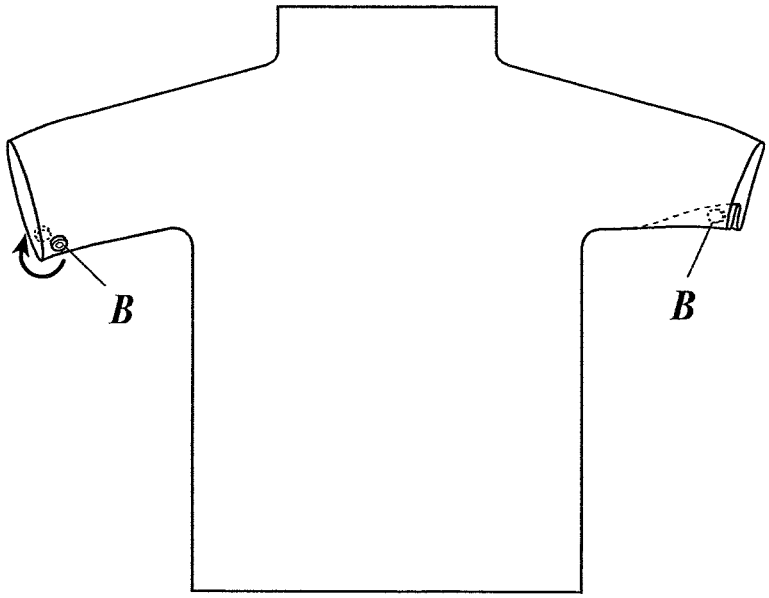
FIG. 34A is an explanatory view of an example the garment body with half sleeves of the air-conditioned garment.
Figure 34B:
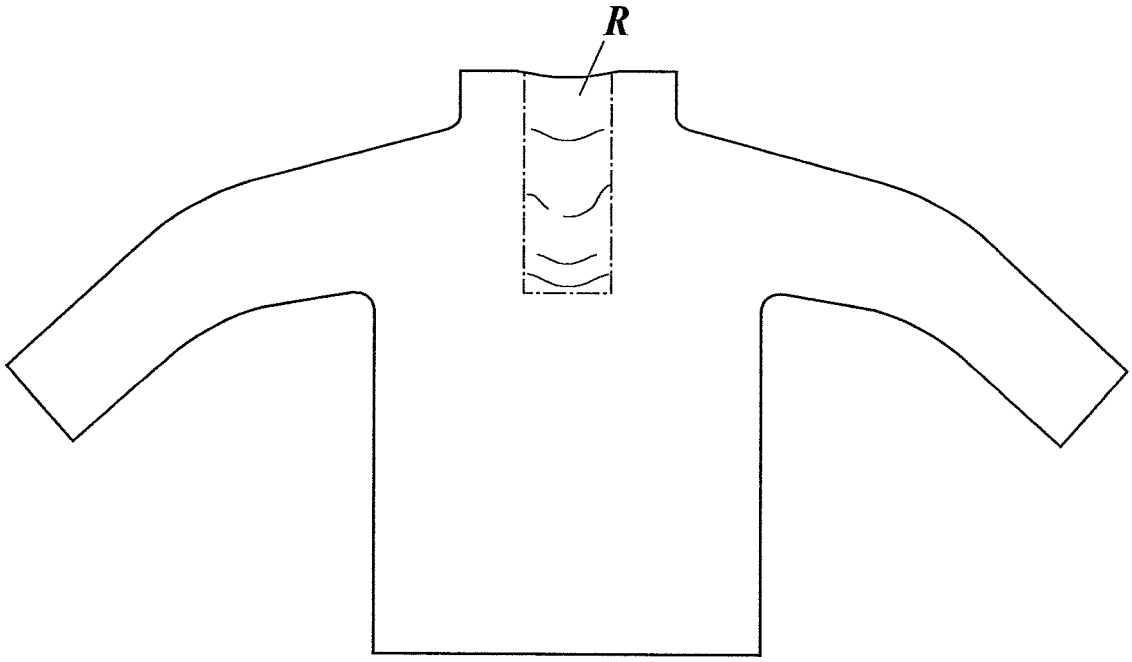
FIG. 34B is an explanatory view of an example the garment body with long sleeves of the air-conditioned garment.
Figure 35A:
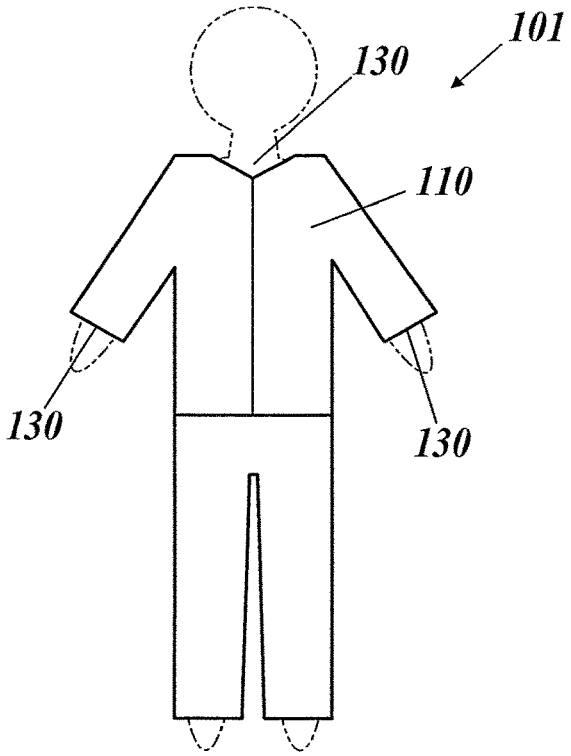
FIG. 35A is a schematic front view of an example of conventional air-conditioned garment.
Figure 35B:
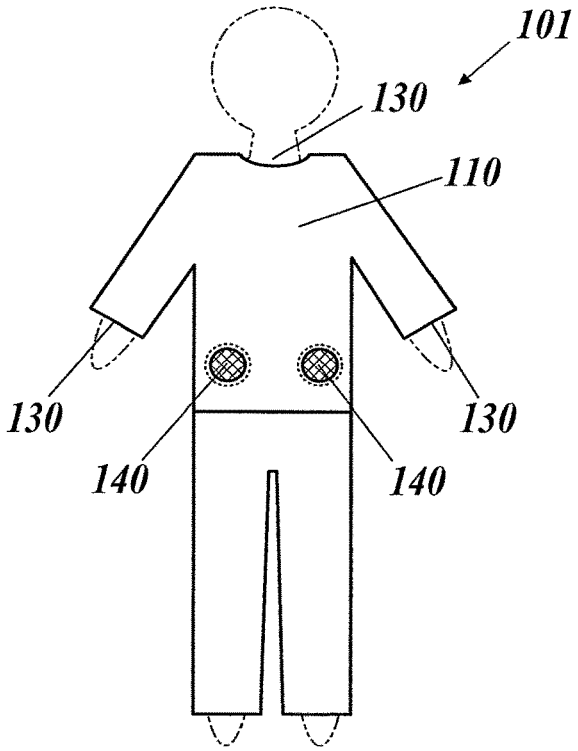
FIG. 35B is a schematic back view of the example of the conventional air-conditioned garment.

In the embodiments, a mechanism for adjusting the air discharging resistance may be provided to the air outlet. For example, when the garment body is a half-sleeve garment, the opening of the half sleeves may be adjustable with buttons B (e.g. snap buttons) disposed at the ends of the sleeves as illustrated in FIG. 34A in order to optimize the proportion of air discharge, which depends on the relationship between the size of the arms and sleeves. Further, to secure the amount of air discharged from a back neck part, a slack may be formed in a rectangular area R near the back neck part, or a spacer may be provided in the rectangular area R as illustrated in FIG. 34B. The mechanism of adjusting the air discharging resistance of air discharging portion is not limited thereto, and a variety of general techniques may be used.

The present invention is not limited to these embodiments, and a various improvements and design changes can be made without departing from the features of the present invention.

INDUSTRIAL APPLICABILITY

The present invention is suitably applicable in the field of production of air-conditioned garment.

REFERENCE SIGNS LIST

100, 100*a*, 100*b*, 100*c* Electric component mounting unit for air-conditioned garment
1, 1*a*, 1*b*, 1*c*, 1*d* Fan
10 Main body
11 Air inlet
12 Flange
121 Upper flange
122 Lower flange
14 Air outlet
15 Fan attacher
16 Cylindrical linker (fan-side linker)
161 Groove
17 Attaching cylinder
2, 2*a* Electric component attaching belt (mounter)
21, 21*a* Belt body (mounter)
22 Belt
23 Attachment adjuster
24 Connecting terminal
25 Cord lock (length adjuster)
3 Power supply
31 Power supply attacher
4 Power cable
5, 5*a*, 5*c*, 5*d* Garment body
51 Cloth
52 Neck
53 Fan opening
54 Hem cord guide
57 Gap securing means
58 Fastener (zipper)
59 Cord guide
6, 6*a* Elastic ring (linking aid)
7, 7*a*, 7*b* Unit
71 Power supply
72 Air inlet
721 Functional space
722 Filter
723 Water-bearing sponge (water bearing means)
73 Air outlet
74 cylindrical linker (linker)
75 Flange
76 Unit fixture
77 Groove
78 Inclined guide
79 Belt (mounter)
101 Air-conditioned garment
110 Garment body
130 Air discharging portion
140 Fan
k1 male fitting
k11 Plug
k12 Fitting spring
k13 Fitting wall
k2 female fitting
k21 Jack
k22 Fitting wall
k3 Waist belt
k4 Neck belt
k5 Hook
2*b* Electric component mounting plate
2*b*1 Circuit board
2*b*2 Fan attacher
2*b*3 Hook
FN11 Fan body
CV11 Cover

The invention claimed is:

1. An electric component mounting unit for a fan-equipped garment, the electric component mounting unit being configured to be used in combination with a garment body having a stretchable fan opening, the electric component mounting unit being configured to be mounted on a body of a wearer by being worn on a back of the wearer, and the electric component mounting unit comprising:

a unit which comprises:

a fan which takes air from outside into the garment body; and a power supply which supplies electric power to the fan; and a belt which is configured to be used to wear the unit on the back of the wearer, wherein:

the unit further comprises a cylindrical linker which is configured to link the unit with the stretchable fan opening of the garment body, an upper flange at an air inlet-side of the cylindrical linker, and a lower flange at an air outlet-side of the upper flange, an outer diameter of the upper flange is smaller than an outer diameter of the lower flange, the upper flange and the lower flange are integrated with the cylindrical linker, the fan and the power supply are integrally housed in a cover, the cover including an air inlet and an air outlet, the cover includes the upper flange, the lower flange, and the cylindrical linker, and the unit is configured to receive the stretchable fan opening of the garment body between the upper flange and the lower flange which are integrated with the cylindrical linker, the stretchable fan opening being received from an upper flange side of the unit by stretching over the upper flange and shrinking to fit on the cylindrical linker, such that an air outlet-side of the unit and the belt are inside the garment body when the unit is worn on the back of the wearer using the belt.

2. The electric component mounting unit according to claim 1, wherein:

the fan includes a cylindrical portion, and the power supply is adjacent to the fan so as not to interrupt air flow from the air outlet.

3. The electric component mounting unit according to claim 1, wherein:

the electric component mounting unit has a single fan, and in the unit, a motor and the power supply are contained in a hermetic container.

4. The electric component mounting unit according to claim 1, wherein the unit further comprises:

an electric component mounting plate to be mounted on the back; and a fan attacher which detachably fixes the fan on the electric component mounting plate.

5. The electric component mounting unit according to claim 1, further comprising:

an air improver which is disposed around an air inlet of the fan and which removes a substance harmful to a human body from air that has been or is to be taken in from the outside, adds a substance useful to the human body to the air, or cools the air, or a functional space for removing dust.

6. The electric component mounting unit according to claim 1, further comprising:

a solar panel, wherein the power supply comprises a power storage for storing or utilizing electricity generated by the solar panel.

7. The electric component mounting unit according to claim 1, further comprising:

a communicator which communicates with an external apparatus; and a controller which controls ON/OFF of the power supply and/or a rotation speed of the fan based on an instruction received from the external apparatus.

8. The electric component mounting unit according to claim 1, wherein the unit further comprises an inclined guide provided at the air inlet-side of the linker, the inclined guide having a tapered shape with an outer periphery decreasing in size toward an upper end thereof.

9. The electric component mounting unit according to claim 8, wherein the inclined guide is provided on the air inlet-side of the upper flange, the upper flange is provided between the inclined guide and the lower flange, and a ring groove is positioned between the upper flange and the lower flange.

10. The electric component mounting unit according to claim 1, wherein the cover further includes an inclined guide provided at the air inlet-side of the linker, the inclined guide having a tapered shape with an outer periphery decreasing in size toward an upper end thereof.

* * * * *